US006019677A

United States Patent [19]

Demster

[11] Patent Number: 6,019,677

[45] Date of Patent: Feb. 1, 2000

[54] MODULAR INTEGRATED TERMINALS AND ASSOCIATED SYSTEMS FOR HEATING AND COOLING

[75] Inventor: Stanley J. Demster, Overland Park, Kans.

[73] Assignee: York International Corporation, York, Pa.

[21] Appl. No.: 08/916,218

[22] Filed: Aug. 22, 1997

[51] Int. Cl.[7] ..... F24F 13/068

[52] U.S. Cl. ..... 454/290; 454/289; 454/316; 454/323

[58] Field of Search ..... 454/284, 289, 454/290, 299, 309, 323, 324, 316

[56] References Cited

U.S. PATENT DOCUMENTS

| | | | |
|---|---|---|---|
| 2,075,258 | 3/1937 | Anderson . | |
| 2,209,121 | 7/1940 | Honerkamp . | |
| 2,281,615 | 5/1942 | Peple, Jr. | 454/309 X |
| 2,339,629 | 1/1944 | Fischer, Jr. . | |
| 2,477,619 | 8/1949 | Kennedy . | |
| 2,996,972 | 8/1961 | Johansson | 454/316 |
| 3,122,087 | 2/1964 | Demuth et al. | 454/299 |
| 3,409,274 | 11/1968 | Lawton . | |
| 3,929,285 | 12/1975 | Daugherty, Jr. . | |
| 3,946,647 | 3/1976 | Larkfeldt . | |
| 4,020,753 | 5/1977 | Efstratis | 454/306 |
| 4,084,616 | 4/1978 | Tragert . | |
| 4,417,687 | 11/1983 | Grant | 236/9 A |
| 4,657,178 | 4/1987 | Meckler . | |
| 4,729,292 | 3/1988 | Marton . | |
| 4,773,197 | 9/1988 | Sullivan | 454/290 X |
| 5,099,754 | 3/1992 | Griepentrog | 454/323 X |
| 5,135,436 | 8/1992 | Levy et al. . | |
| 5,238,452 | 8/1993 | Levy et al. . | |
| 5,304,094 | 4/1994 | MacCracken . | |
| 5,338,254 | 8/1994 | Farrington . | |
| 5,344,364 | 9/1994 | Michlovic | 454/290 X |
| 5,358,444 | 10/1994 | Helm et al. . | |
| 5,403,232 | 4/1995 | Helm et al. . | |
| 5,607,354 | 3/1997 | Mill et al. | 454/290 X |

FOREIGN PATENT DOCUMENTS

| | | | |
|---|---|---|---|
| 0 207 718 A2 | 1/1987 | European Pat. Off. . | |
| 207 718 | 1/1987 | European Pat. Off. | 454/290 |
| 0 607 116 A1 | 7/1994 | European Pat. Off. . | |
| 0 621 451 A2 | 10/1994 | European Pat. Off. . | |
| 26 14 559 | 10/1977 | Germany | 454/289 |
| 26 14 559 A1 | 10/1977 | Germany . | |
| 34 17 002 A1 | 11/1985 | Germany . | |
| 43 01 757 C1 | 5/1994 | Germany . | |
| 90/00241 | 1/1990 | WIPO | 454/290 |

OTHER PUBLICATIONS

Krantz Komponenten, H. Krantz–TKT GmbH, Product Catalog for Air–Conditioning Components and Systems.

Fred S. Bauman & Edward A. Arens, Task/Ambient Conditioning Systems: Engineering and Application Guidelines, Univ. Cal. at Berkeley Center for Environmental Design Research, 1–67 (Oct. 1996).

*Primary Examiner*—Harold Joyce

*Attorney, Agent, or Firm*—Finnegan, Henderson, Farabow, Garrett & Dunner

[57] ABSTRACT

Modular terminals for supplying conditioned air to spaces within buildings can be mounted and configured to provide improved heating, cooling, ventilation, and mixing of the supplied air with the space air. The flexibility in arranging the modular terminal components, such as air inlets, outlet grilles, dampers, and induction sleeves, permits for selectively altering the flow pattern, quality, volume, and velocity of air introduced into a space. The modular terminals can selectively draw air from a plenum, duct, or both. The terminals accommodate electrical wiring for office equipment, and also may accept flexible ducting to deliver conditioned air from a desktop or other furniture. The modular terminals also are part of a system and method for conditioning building spaces whereby a number of terminals are controlled in response to selected sensor readings. Various air handling units combine with the terminals to cycle the air and supply a source of filtered and conditioned air to the terminals.

70 Claims, 16 Drawing Sheets

MODULAR INTEGRATED TERMINALS AND ASSOCIATED SYSTEMS FOR HEATING AND COOLING

BACKGROUND OF THE INVENTION

1. Field of the Invention

The present invention relates to heating and air conditioning systems and air distribution terminals that are preferably incorporated into underfloor heating and air conditioning systems.

2. Description of the Related Art

There are a number of ways to heat and air condition spaces within buildings. In In many office buildings heating and air conditioning is achieved through ducts and plenums in the ceilings of the buildings. While such systems are generally acceptable in many situations, these systems and the heating and cooling principles applied in such systems have drawbacks. By means of example only, because the cooling air is introduced from the ceiling, it forces some of the warmer air in the ceiling downward and may mix with it. This results in cooling inefficiencies, reduction in ventilation effectiveness, and also tends to cause pollutants in the ceiling area to mix with air throughout the space being conditioned. Ceiling-based systems also are often expensive to install, since all of the required plenums, ducting, and terminals, among other things, must be placed in the ceilings. Moreover, it is difficult and time consuming to service such systems, after they are installed. Ceiling systems are also relatively difficult and expensive to modify or reconfigure, as circumstances require. For these and other reasons there has been a need for alternate heating and air conditioning systems, particularly for large facilities having one or many stories. This need has become more pronounced because buildings now often need to have the capacity to permit underfloor electrical wiring for power, computer, and telecommunication applications, applications that commonly need to be changed frequently after they are originally installed.

One alternative proposed system and method of heating and cooling buildings has been underfloor heating, ventilating, and air conditioning ("HVAC") systems in which the heating and/or cooling air is applied through openings in the floor. While such systems in theory have some benefits over other commercial systems, the underfloor systems and methods known to applicant have had a number of drawbacks that have significantly narrowed the acceptability of such systems to date. Primarily, existing underfloor systems generally provide a limited range of configurations, thus falling short of meeting varied, known operating conditions. This limited capability arises in part because these systems are generally designed to operate under constant volume. In addition, the floor air delivery devices that are known to applicant are simple grille devices that direct the air in a fixed pattern regardless of whether the pattern is suitable for the specific application. Such devices are pressure dependent devices that have an air velocity that is dependent upon the entering air pressure at the grille face. This produces another disadvantage—namely, at low flow, "puddling" of the more dense conditioned air may take place, which is very uncomfortable to the ankles and feet of the occupants. Yet another drawback results from the high cost to adequately cool different zones. For example, to provide temperature control, often these systems include a number of different zones that are separated by plenum dividers. In sum, the underfloor devices and systems known to the applicant are inflexible in construction, have high operating costs, and are generally intended to meet a limited range of air distribution conditions.

Another possible alternative would be to apply ceiling terminal ducting technology to floor systems. So far, this approach has been impractical and consequently has met with little success.

SUMMARY OF THE INVENTION

An object of the present invention is to provide an underfloor heating and cooling system that represents an improvement over commercially available HVAC systems.

Another object is to provide an improved underfloor air terminal.

Still another object is to provide a modular integrated terminal concept in which common components of a terminal are assembled using a number of different components, to thereby provide a plurality of terminal models that can be incorporated into an economic and efficient HVAC system.

Yet another object is to provide modular terminal designs that are readily adaptable to a wide number of HVAC applications.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a modular design for providing heating, ventilating, and air conditioning to the interior of a building, the modular design comprising a box capable of accepting a plurality of attachments, said box comprising two pairs of opposed side walls, a bottom surface, at least one inlet air passageway formed through at least one of said side walls, and at least two outwardly extending engagement flanges formed along the upper portion of at least two of said side walls. The invention further comprises a system for heating, ventilating, and air conditioning individual spaces on a building floor comprising a plurality of modular boxes, air handling units, plenums, ducts, and controls. Furthermore, the invention comprises a method for providing heating, ventilating, and air conditioning to meet a varying range of conditions in discrete spaces on a building floor, the method comprising means for an occupant of said discrete space to adjust the heating, ventilating, and air conditioning output of the modular boxes.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to exemplary embodiments of the invention, examples of which are illustrated in the accompanying drawings. Wherever possible, the same reference numbers will be used throughout the drawings to refer to the same or like parts.

As will be explained more fully below, the present invention is directed to modular integrated terminals, and systems and methods in which one or more of the modular integrated terminals are incorporated, for controlling the airflow of supply air to be conditioned by an HVAC system. The terminal of the present invention has one or more common chasses or housings to which a variety of different components can be added to provide an optimum terminal for a given circumstance. One or several of the modular terminals can then be integrated into an HVAC system to heat and/or cool the building. The terminals are preferably designed to be installed in the floor of a building having an underfloor HVAC system. They can, however, be used in other HVAC applications.

Figure 1:
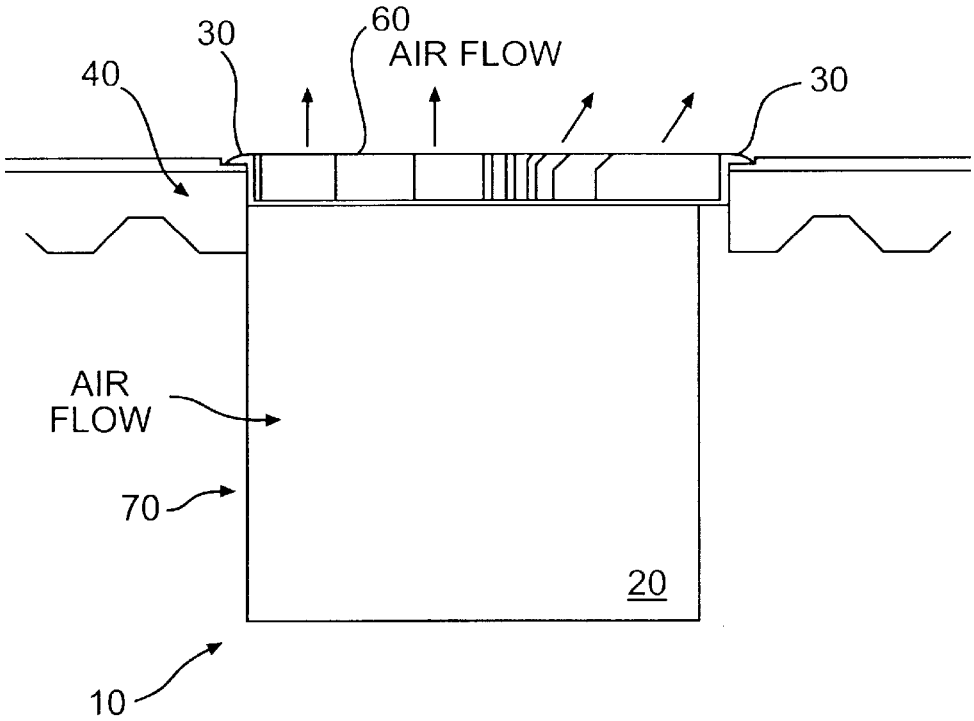
FIG. 1 is a cross-sectional view on line 2—2 of FIG. 2, illustrating a first embodiment of the modular integrated terminal of the present invention.

As shown in FIG. 1, the terminal 10 of the present invention includes a housing 20 to which various components can be attached. The illustrated terminal 10 has four side walls or panels and a bottom which forms a housing 20 with an opening at the top. The housing 20 preferably includes at its top outwardly extending lips 30 that extend from at least two opposite sides of the housing 20. The lips 30 engage the floor 40 when the terminal 10 is installed and thereby hold it in place.

The terminal 10 preferably includes a trim ring 50 that runs around its perimeter. The trim ring 50 preferably includes an outwardly extending flange or lip at its top and an inwardly extending flange or lip at its bottom. The trim ring 50 preferably fits within the housing 20 and extends over the housing's lip 30. As an alternative, the trim ring 50 can be fixed to or formed with the housing 20 of the terminal 10 and thus be an integral part of the terminal 10.

Figure 2:
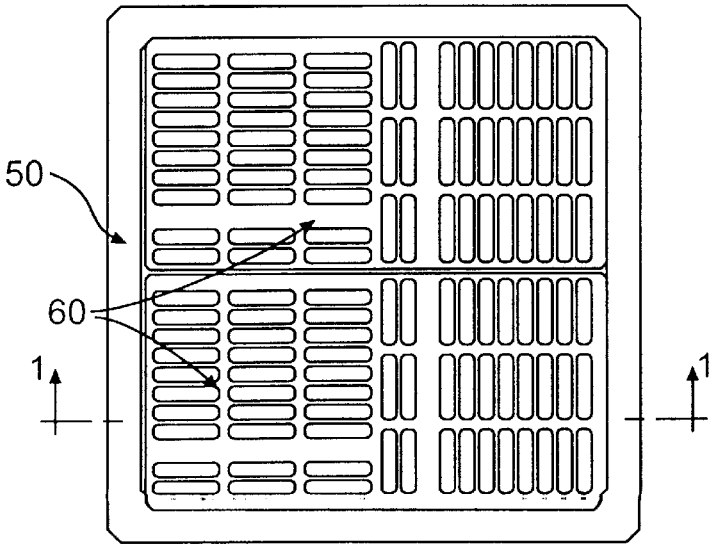
FIG. 2 is a plan view of a first embodiment of the modular integrated terminal.
Figure 3:
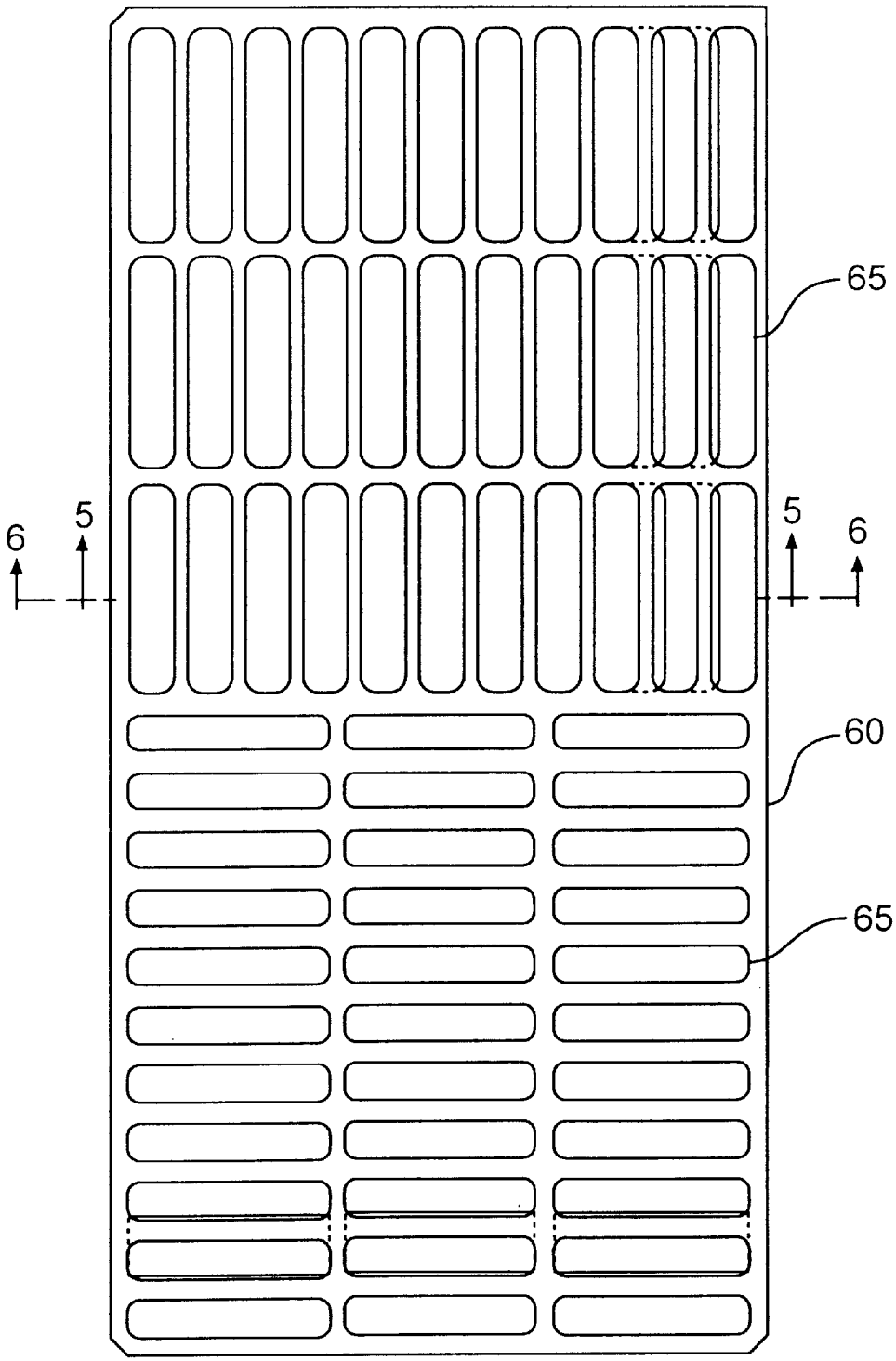
FIG. 3 is a top view of an embodiment of one of two air grilles shown in FIG. 2.
Figure 4:
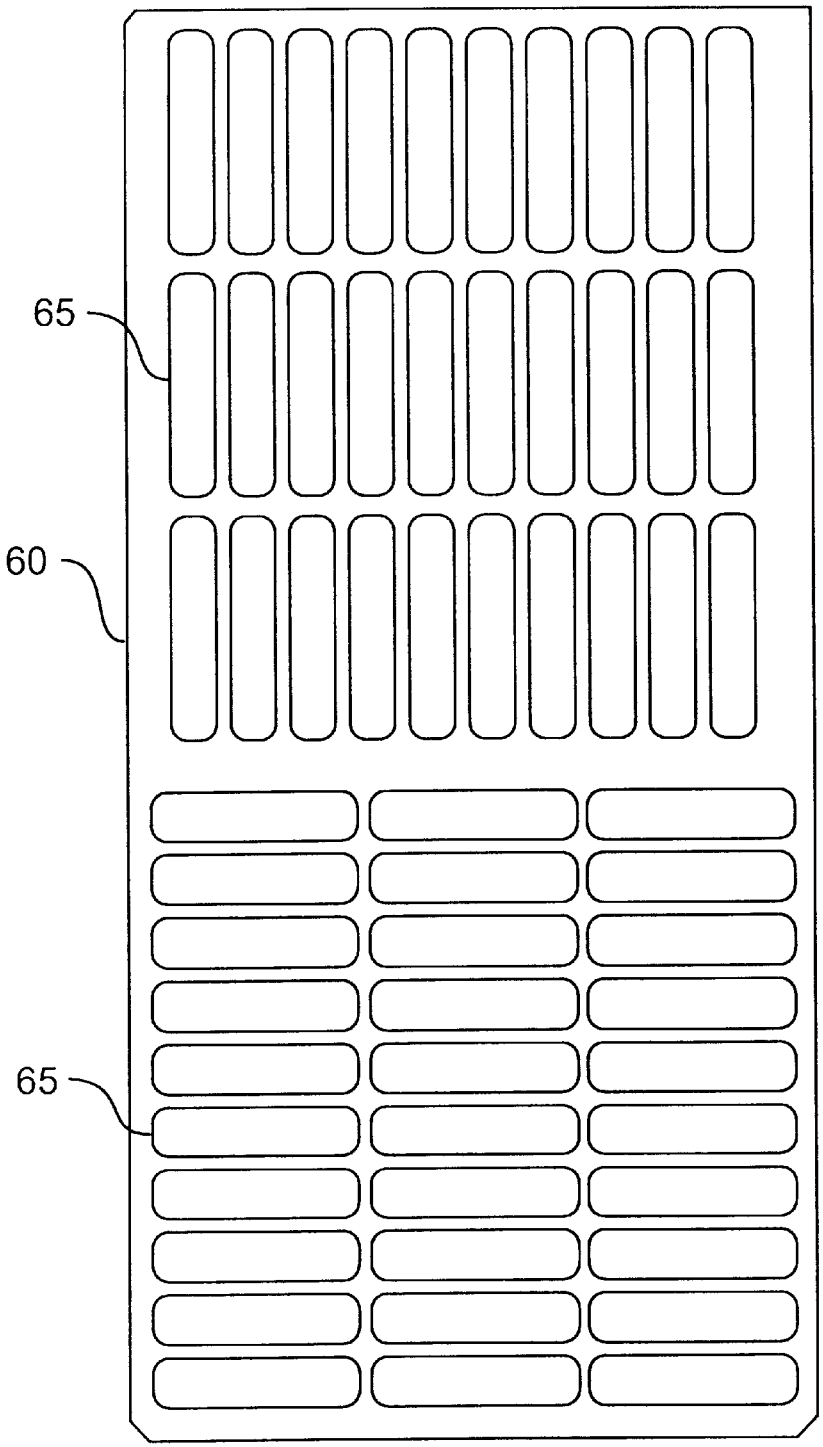
FIG. 4 is a bottom view of the grille shown in FIG. 3.

As shown in FIG. 1, the terminal 10 is installed into a hole cut in the floor 40. The hole is preferably sized to snugly accept the terminal 10. The outwardly extending lip 30 of the housing 20 engages the top surface of the floor 40 and holds the terminal 10 in place. As also shown in FIGS. 1 and 2, the terminal 10 of the present invention includes one or more grilles 60 that fit within the trim ring 50 and are held in position by the inwardly extending flange of the trim ring 50. As shown in FIG. 2, the terminal 10 of the present invention preferably includes one or more separate grilles 60, to permit increased control of the direction of air flow from the terminal 10 and into the space being conditioned.

By way of example, two identical grilles 60 can be positioned in the trim ring 50. Each of those grilles 60 can have different flow channels at different locations of the grille 60, as well as on opposite sides of the grille 60. By means of example and with reference to FIGS. 3, 4, 5, and 6, the grille 60 can be made such that the air can be delivered vertically upward when the grilles 60 are held in one position. By turning the grilles 60 over and positioning them properly, the air can be directed from the terminal in up to 16 distinct flow patterns, as shown in FIG. 6A where the arrows 61 indicate the direction of air leaving the grille 60 at an acute angle and the cross-haired circles 62 indicate air leaving the grille 60 vertically . As an example, one section of the grille 60 can be positioned to direct air vertically, while the other grille 60 directs air outwardly in two directions, at a pre-selected angle or angles.

Figure 5:
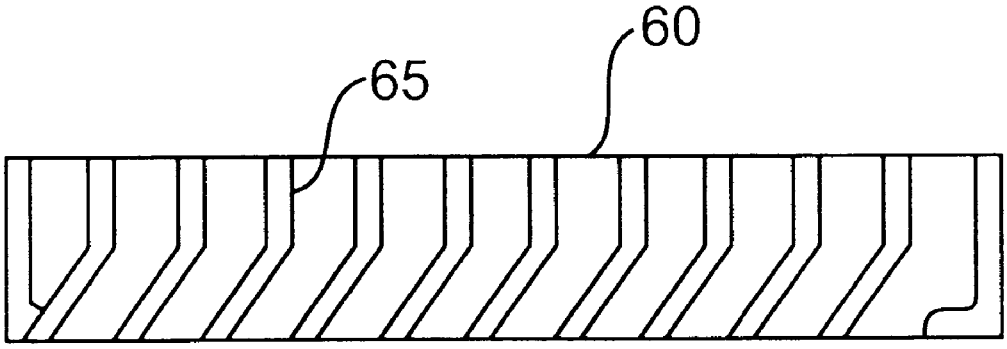
FIG. 5 is a cross-sectional view on the line 5—5 of the grille in FIG. 3.
Figure 6:
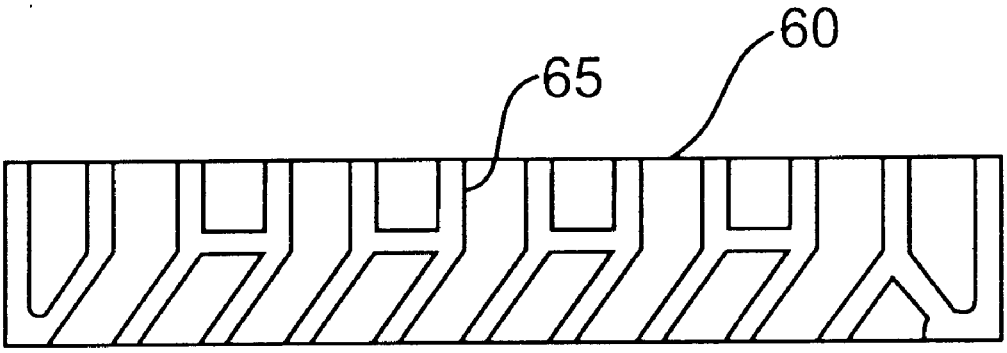
FIG. 6 is a cross-sectional view on the line 6—6 of FIG. 3, illustrating a modified version of the grille.
Figure 6A:
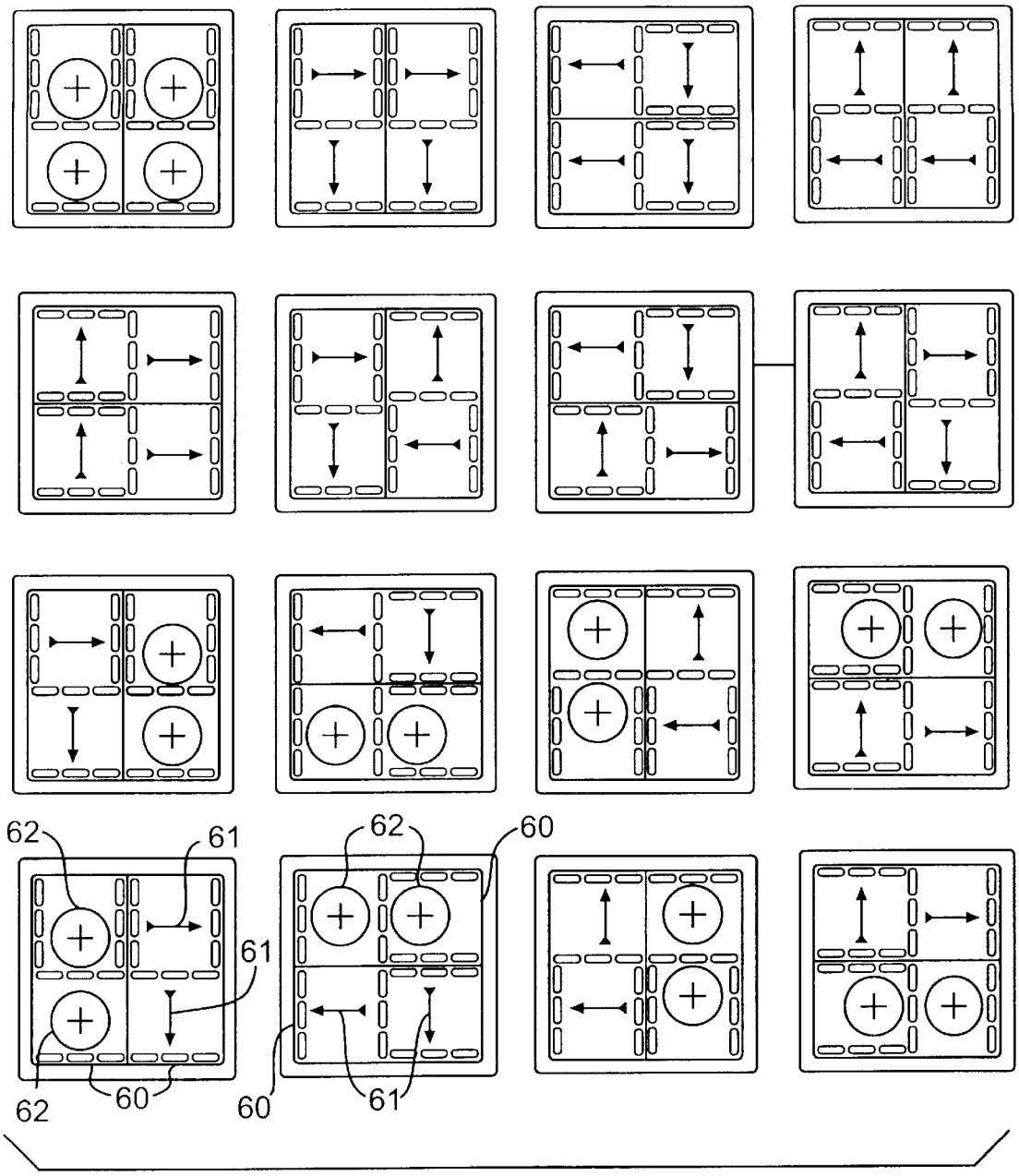
FIG. 6A is a top view of various grille air flow patterns.

In one embodiment, the two grilles 60 (one of which is illustrated in FIGS. 3 through 6) having dimensions of 9.94 inches by 4.92 inches are placed in the opening of the trim ring 50 having an opening of 9.94 inches by 9.44 inches. The grille 60 has three horizontal rows of 11 elongated air flow channels 65 at the top and three vertical columns of 11 elongated air flow channels 65 at the bottom. In one example, these channels 65 are approximately 1.5 inches long and 0.31 inch wide. As shown by the cross-section at FIGS. 5 and 6, the channels 65 on one side of the grille 60 direct the flow of air vertically from the face of the grille 60, while the channels 65 on the other side direct the flow at an angle. One exemplary angle of deflection is 31°. The grille design shown in FIG. 5 provides standard induction, while the grille design shown in FIG. 6 provides high induction. As is apparent, different grille designs and sizes can be designed to provide different flow patterns. The invention thus provides versatility in arranging and modifying air patterns and flow into the space to be conditioned.

Trim rings 50 of different colors or designs can then be fitted onto the terminal 10, and grilles 60 of different colors or designs can be fitted within the trim ring 50. As a result, the terminal 10 of the present invention permits the use of a wide range of aesthetic and engineering design considerations. For example, the portion of the terminal 10 visible to room occupants can be selected to match room appurtenances such as electrical distribution devices, telecommunications equipment, carpet, tile, furniture, and other furnishings.

The terminal 10 of the present invention can be formed in a wide variety of shapes and can be made of a wide variety of materials, depending upon the application and other design considerations. By way of example only, the walls and bottom of the terminal 10 can be formed of sheet metal, and the trim ring 50 and grille 60 can be formed of plastics or similar synthetic materials meeting flame spread and smoke retardant characteristics as mandated by applicable building codes. One such material is polycarbonate. Preferably, the terminal 10 is symmetrically designed so that it can be rotated to a variety of positions within the hole in the floor 40 where it is to be installed. By means of example, the illustrated embodiment is generally square in cross-section. An exemplary terminal 10 might have a horizontal cross-section of 10 inches by 10 inches. The terminal 10 can have a variety of heights, with presently preferred heights being either ten inches or five inches, for a terminal 10 having a horizontal cross-section of 10 inches by 10 inches. Other shapes, such as regular polygons or a circular cross-section are also acceptable. As explained below, the symmetrical shape of the preferred terminals 10 permits a user of the terminal invention to alter the air flow characteristics of a given terminal 10, by simply rotating the terminal 10 to a different position relative to the air flow in the floor plenums.

As will be explained below, each embodiment of the terminals 10 of the present invention includes at least one air inlet formed in at least one side or bottom panel of the terminal 10. The air inlet 70 in the embodiment shown in FIG. 1 is formed in the left side panel and, by means of example only, is in the form of a cut-out having dimensions of 10.5 inches by 10.5 inches. A plurality of apertures formed in the side wall can also be used. Several embodiments of the terminal 10 include multiple air inlets, along with one or more devices integrally incorporated into the terminal 10 to control the air flow. Some, but by no means all, of the possible permutations of the terminals 10 of the present invention and some of the respective attributes and advantages of such terminals 10 are described below.

All of the modular integrated terminals ("MITs") of the present invention are purposely designed to fit in a hole in the floor 40 that can be standardized. Preferably, the MIT will share dimensions (in addition to color) with electrical devices used in the floor 40 so that one floor opening can be commonly used for terminals 10 of the invention, as well as electrical and mechanical devices. This feature minimizes costs. The elimination of the need for odd sized openings reduces production and installation costs, as well as a need to inventory different spare parts and panels. The use of standard openings also allows standard panels to be made at the factory, which is much less expensive than a field-cut panel. This aspect of the invention also permits the use of standard templates and cut-out techniques, when field cut-outs must be made.

The embodiment shown in FIGS. 1 and 2 is, for purposes of reference, designated a model MIT-A terminal. This terminal 10 includes the basic housing 20 or chassis described above, one or more grilles 60, and at least one inlet 70 formed in a side or bottom panel of the housing 20. In a preferred embodiment, the inlet 70 is cut into a side wall of the housing 20 and is sized to accept flow of air applied to the terminal 10 through a plenum, preferably in the floor of a building. The air handling system of the HVAC system for the building supplies air, preferably pressurized air, to the plenum. In operation, the air supplied to the plenum flows through the inlet 70, into the terminal 10, and then out through the channels 65 in the grille 60 into the space to be conditioned. Either heating or cooling air can be supplied to the plenum, depending upon the environment where the terminal 10 is placed. In most applications, cool, conditioned air will be supplied to the plenum and then to the spaces to be conditioned, through the model MIT-A terminal.

The MIT-A can be placed in various positions in the hole in the floor, to thereby change the orientation of the inlet 70 relative to the velocity or direction of the air supplied to the plenum. This aspect of the invention allows the user to control to some degree the relative output of air applied through the terminal 10, particularly if there is a velocity pressure component present in the plenum. In that circumstance, the supply air inlet 70 can be faced into, parallel, or against the velocity component to adjust the volume of air entering the device. When the inlet 70 is aimed into the air stream the unit will deliver more air. When it is aimed to the side of or opposite the air flow in the plenum, the air delivery volume will be reduced. This form of pressure adjustment provides better control over the air flow, with or without other control devices, which are described below.

The model MIT-A also permits the direction of flow into the room (conditioned space) to be controlled, by varying the position and orientation of the grilles 60 of the invention. For example, if the two grilles 60 of FIG. 2 are used with this terminal 10, the air can be directed to flow upwardly throughout, or can be directed at angles away from the face of the terminal 10. It also can be directed in a combination of upward and angular flow. In addition, the terminal 10 can be modified to accept more than two grilles 60, e.g., four separate grilles 60, without departing from the scope of the invention. Each of the four grilles 60 can have a pre-selected flow pattern. In addition, one or all of the grilles 60 can be replaced with an impervious plate, to decrease or stop the flow of air. Moreover, the grilles 60 can be replaced with grille inserts that provide a connection point for a flexible duct that directs air to a specific location. Such a design allows the MIT to act as an air source for the distribution of air to furniture or desktop outlets. This aspect is described more fully below.

The MIT-A terminal can be used as a grille plus chassis or as a grille alone to apply air to spaces where the air is transferred through plenums, preferably plenums in the floor. By means of example, these terminals 10 can be used in interior spaces where only cooling is required, on a regular basis. Cooling air typically would be applied to the plenum in a slightly pressurized state, so that the air will flow from the plenum, through the terminal 10, and into the space to be conditioned.

Figure 7:
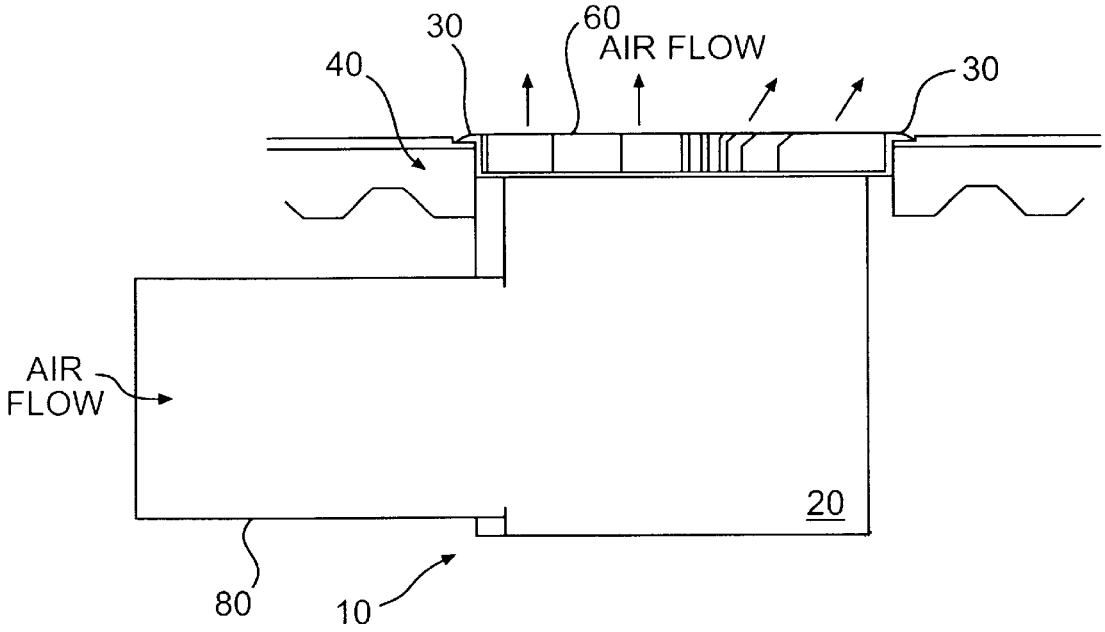
FIG. 7 is a cross-section of a second embodiment of the modular integrated terminal of the present invention.

A second embodiment of the terminal 10 of the present invention, the model MIT-B, is shown in FIG. 7. This embodiment is similar to the MIT-A, with the exception that in this embodiment one panel includes a hole, or hole and flange arrangement, which accepts a duct 80. In this embodiment, the air supplied by the terminal 10 to the space is supplied to the terminal 10 only by ducting 80. The MIT-B can incorporate an individual single-speed or variable speed fan that is controlled to control the flow of air. A terminal 10 with its own fan or fan/coil/filter can be used, for example, in a system where the air in the plenum is not pressurized, where flow control through the use of a variable speed fan is desired, or where some further conditioning of the plenum air is desired. Thus, faster conditioning responses and extra filtering can be achieved. In both the model MIT-A and MIT-B, the terminal 10 receives air from only one source and supplies the air to the space through one or more grilles 60, which can be repositioned or replaced with different grille designs, as needed. Furthermore, all MITs are designed to fit into the floor opening by tilting the terminal 10 or removing the duct 80 (and motor, if one is used), as required.

Figure 8:
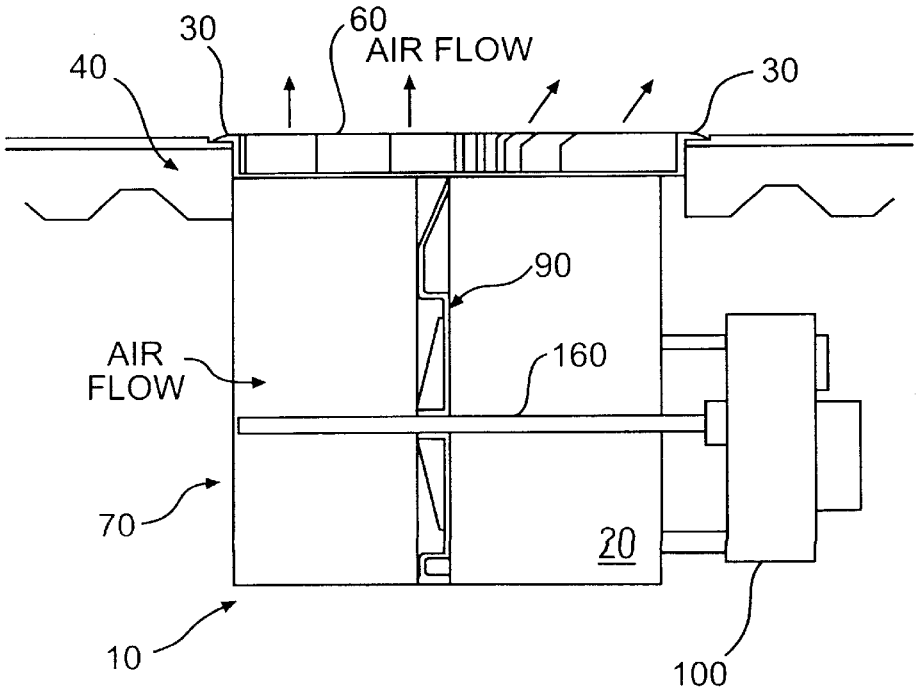
FIG. 8. is a cross-section of a third embodiment of the modular integrated terminal of the present invention.

A third embodiment, the model MIT-C, is shown in FIG. 8. This embodiment includes the air inlet 70 to the plenum and a grille 60 and is in that respect similar to the model MIT-A, as shown in FIG. 1. However, this terminal also includes a damper 90 that is located in the housing 20 and is positioned opposite the air inlet 70 through which air from the plenum can enter into the terminal 10. As shown, the damper 90 preferably is a slidable damper 90 that is at least large enough to cover most, if not all, of the inlet 70 when it is slid to a position most proximate to the inlet 70. Most preferably, the damper 90 extends from the top to the bottom of the housing 20, and from one side to the opposite side. The damper 70 preferably is sized to snugly fit within a vertical cross-section of the housing 20.

The damper 90 is slid toward and away from the air inlet 70 by an acceptable mechanism. While the damper 90 can be moved solely by hand operation, for example by use of a recessed handle, key, or knob extending to the top of the terminal 10 (thereby avoiding obstruction), it preferably is moved by a control device and system. By means of example, the damper 90 receives a threaded drive screw 160 that in turn is rotated by a motor 100, according to control signals generated by a thermostat or similar control. As the motor 100 rotates, the screw 160 engages a threaded aperture or nut on the damper 90 and causes it to slide relative to the housing 20. The terminal 10 of the present invention is designed to permit simple attachment of a motor 100 in the field. For example, the motor 100 can be snapped onto the terminal housing 20 wall using toolless, quick connection. Other mechanical and electrical arrangements and devices, such as a plunger, can also be used to move the damper 90, in response to a control signal.

In the MIT-C, the integral, sliding damper 90 modulates the flow of air in a very specific manner. The preferred embodiment of the MIT-C damper 90 performs two functions. The damper 90 reduces the flow of air into the terminal 10 and reduces the active face area of the grille 60 of the terminal 10 at the same time. Unlike conventional remote dampers, this causes the static pressure acting on the air leaving the grille 60 to remain relatively constant rather than diminish, as air flow is reduced. The air leaving the grille 60 at the various damper 90 positions exits at a relatively constant velocity, with the result that the air flowing from the terminal 10 retains kinetic energy so it can mix better with space air. By adjusting the design geometry of the grille 60 and damper 90, it is possible to produce a unit that has a constant, increasing, or decreasing velocity as the damper 90 modulates. In the design illustrated in FIG. 8, the air velocity remains relatively constant or increases slightly as the damper 90 moves toward the closed position.

The air distribution provided by the MIT-C provides improved comfort conditions, particularly at lower room air conditioning load levels. Conventional damper mechanisms limit air mixing at low flow and load conditions, potentially causing cold drafts and discomfort. The MIT-C thus can be applied to achieve an acceptable variable air volume system, an advantage over conventional terminal units limited to constant volume systems. Moreover, the MIT-C complements the MIT-A and MIT-B units, which operate most effectively in a constant volume system.

The damper 90 of the MIT-C can be placed at any position within the range of the drive mechanism. In addition, the model MIT-C terminal can include one or more stops, formed on the housing 20, to limit the travel of the damper 90 and thereby set pre-selected minimum and maximum flow positions for the damper 90. This terminal 10, like terminals MIT-A and MIT-B, also applies only one source of air. In the MIT-C, the air is supplied to the terminal through a plenum with pressurized air.

The MIT-C can be used in applications where hot and/or cold air is supplied to the space served by the terminal 10. The slidable damper 90 is preferably controlled according to sensed parameters in the space. For example, the motor 100 can be controlled to slide the damper 90 toward open or closed positions, in response to temperatures sensed in the space.

Figure 9:
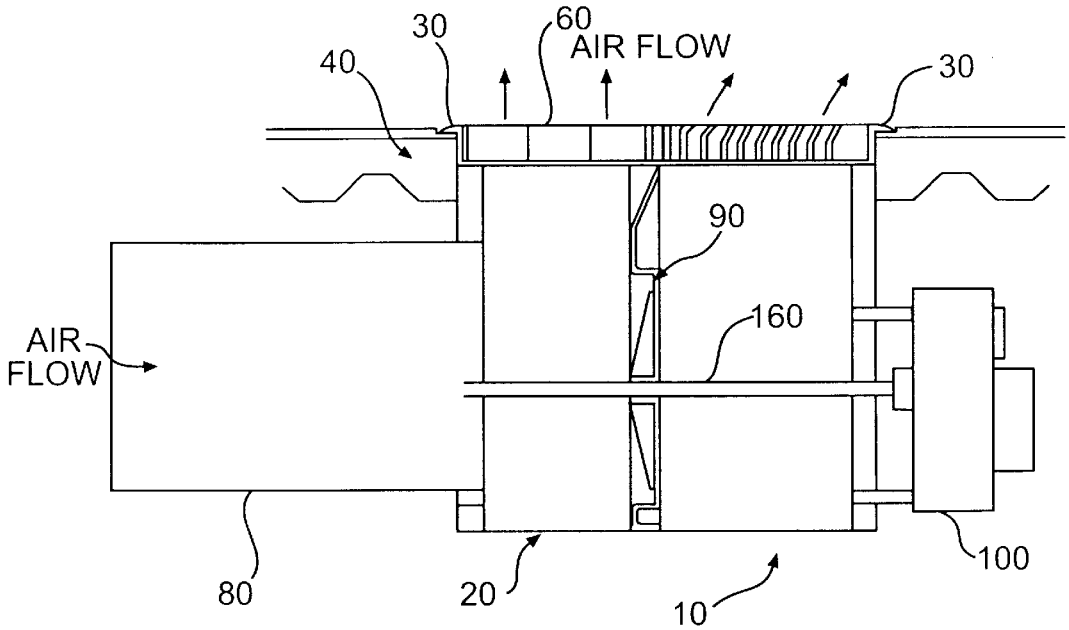
FIG. 9 is a cross-section of a fourth embodiment of the modular integrated terminal of the present invention.

A fourth embodiment, the MIT-D, is shown in FIG. 9. This embodiment includes the components of the MIT-C, with the addition of a ducted inlet 80. In this embodiment, air flow is introduced into the terminal 10 through the duct 80, and the flow of that air is controlled by the movement of the damper 90. The effect and application of the damper 90 is the same as that described with respect to the MIT-C. Similar to the MIT-B, the MIT-D can incorporate an individual single speed or variable speed fan that is controlled to control the flow of air if the plenum is not pressurized. Also like the MIT-B, the MIT-D can have its own fan/coil/filter. This is desirable, for example, in medical rooms where quick warm-up or extra filtration is required. In this case, the fan overcomes the additional pressure requirement of the coil/filter. The fan can be single-speed or variable-speed, as required, to balance the desired air flow.

Figure 10:
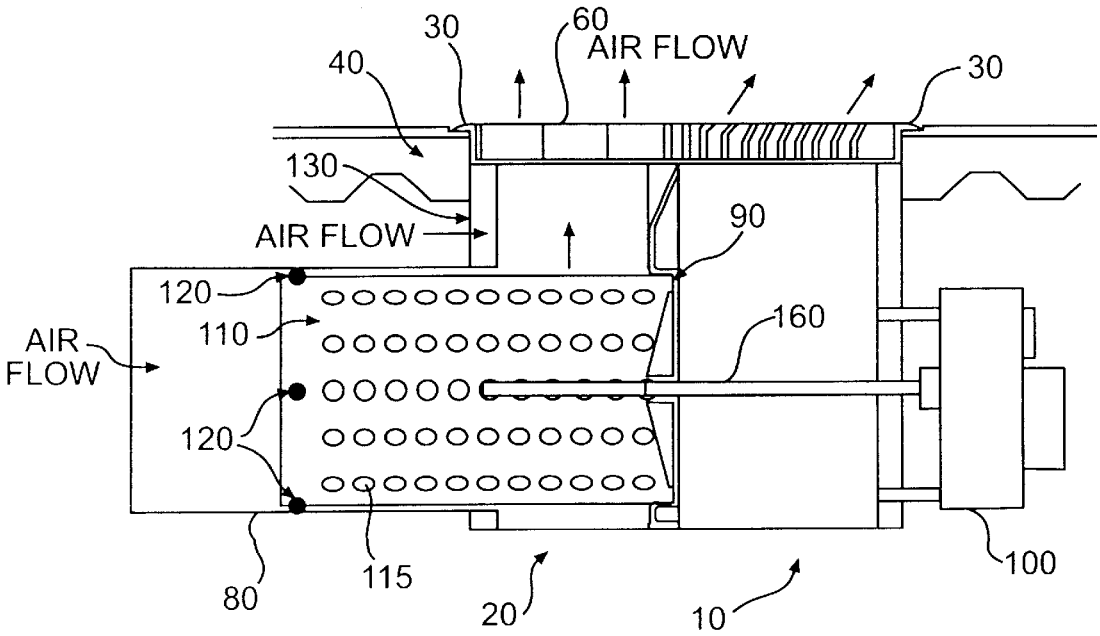
FIG. 10 is a cross-section of a fifth embodiment of the modular integrated terminal of the present invention.

A fifth embodiment, the MIT-E, is shown in FIG. 10. This embodiment includes the components of the MIT-D with the addition of an induction sleeve 110 that is fixed to the damper 90 and includes a plurality of apertures 115 along its length. The induction sleeve 110 is designed to slide within a duct connection 80 for receiving conditioned air. The MIT-E includes a plenum air inlet 130 to accept air supplied by the air plenum. The induction sleeve 110 moves with the damper 90 and provides two functions. It first modulates the flow of the ducted supply air. Second, it distributes the conditioned air in a manner that causes high induction and mixing of the conditioned air and plenum air before entering the grille 60. Most preferably, the apertures 115 are arranged along the sleeve 110 in horizontal, parallel rows, aligned with the direction of the inlet primary air flow. This arrangement provides effective induction of the secondary plenum air. The sleeve 110 construction is adjusted so that the ratio of conditioned air to plenum air can be precisely controlled throughout the modulation range of the damper 90.

In the illustrated embodiment, the sleeve 110 is an elongated cylinder having a plurality of apertures 115 formed about its circumference and along its length. By means of example, the sleeve 110 can have a diameter of 4.76 inches and a length of 9.5 inches. Such a sleeve 110 can have 12 rows of 7/16 inch diameter apertures 115, spaced 30° on center, parallel to the sleeve 110 axis. The sleeve 110 and duct 80 are positioned about a horizontal axis of the terminal 10, with positioning buttons 120 formed on the sleeve 110 or duct 80 to maintain concentric clearance between the sleeve 110 and duct 80. In order to provide sufficient panel clearance and to allow enough space for proper air distribution through the grille 60, the sleeve 110 is located closer to the bottom of the terminal 10. This design allows the sleeve 110 to introduce primary conditioned air into the terminal 10, with the sleeve 110 surrounded by the secondary plenum air. This design promotes good mixing and eliminates the need to insulate the sleeve 110 for condensation. There is adequate air motion and mixture available to carry away any condensate that may form. The sleeve construction combined with the grille design provides desired induction and mixing within the terminal 10 and externally of the MIT-E, above the terminal 10. As a result, cold, conditioned primary air can be used in an underfloor system with terminals 10 of the present invention, without causing discomfort to persons in the spaces being conditioned.

In one application of the MIT-E, a supply of cold, conditioned primary air is supplied to the duct of the terminal 10, and return air, preferably from the ceiling, is supplied to the floor plenum. For example, the conditioned air supplied to the duct 80 can be cold air within the range of 45° F. or colder and the plenum air might be in the order of 78° F. This air is mixed within the terminal 10, and further mixes with room air as it exits the grille 60, so that the air ultimately applied to the space is at a comfortable temperature range.

Figure 11:
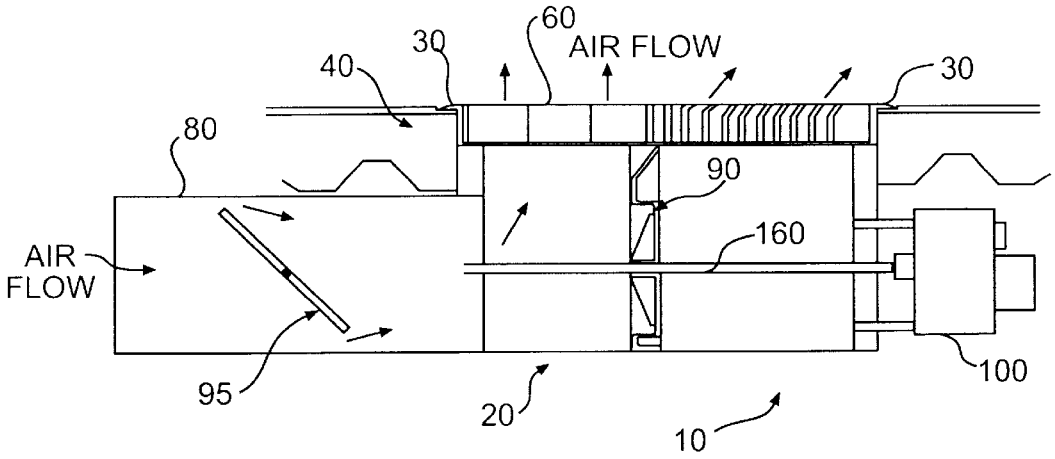
FIG. 11 is a cross-section of a sixth embodiment of the modular integrated terminal of the present invention.

A sixth embodiment of the terminal of the invention is the MIT-F, shown in FIG. 11. This terminal is akin to the MIT-D, but with the capability of pressure independent operation. The MIT-F includes an inlet duct 80 containing a pressure control damper 95, which is controlled by a thermostat sensing inlet pressure and velocity to maintain a constant flow of air for given thermal loads regardless of fluctuations in underfloor plenum pressure. In a preferred embodiment, the unit has dimensions of 10 inches long by 10 inches wide by 5 inches tall. The reduced height and pressure independent operation of this embodiment permits the MIT-F to operate in low floors, where the tighter space and varying plenum pressure render other units impractical or ineffective.

Figure 12:
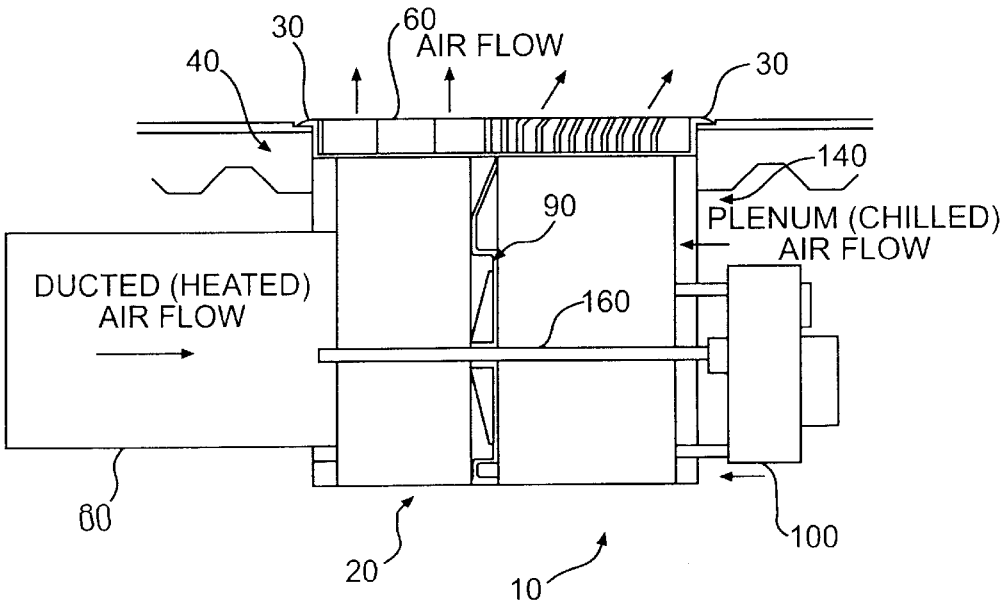
FIG. 12 is a cross-section of a seventh embodiment of the modular integrated terminal of the present invention.

A seventh embodiment of the modular terminal of the present invention is the MIT-G, shown in FIG. 12. This terminal is like the MIT-D, with the addition of a second air inlet 140 at the end of the terminal opposite the duct 80. Because of the combination of this second air inlet 140 with the damper 90, the MIT-G can provide three functions. First, by sliding the damper all the way to the right so the inlet to the plenum is closed, the MIT-G acts as a return unit. With the damper 90 in this position, the terminal 10 only can supply air from the duct 80. Second, the MIT-G provides a supply function from a pressurized floor plenum when the damper 90 is in an intermediate position or slid to the left. Third, this embodiment can act as a heating supply when the fan heater is on with the damper 90 all the way to the right, or can provide minimum ventilation by placing the damper 90 in an intermediate position to mix heated return air from the space and ventilating air from the floor plenum.

The modular terminal components can also provide a FAM module, a floor module for electrical power and/or telecommunications applications. This module shares the size, appearance, and trim ring of the above described MITs, but is not used for HVAC application. Instead, the module has plates including electrical outlets or terminals for acceptance of computer components or telephones. The adaptability of the FAM module allows aesthetic coordination with room fixtures, outlets, and terminals, while reducing system costs.

Figure 13:
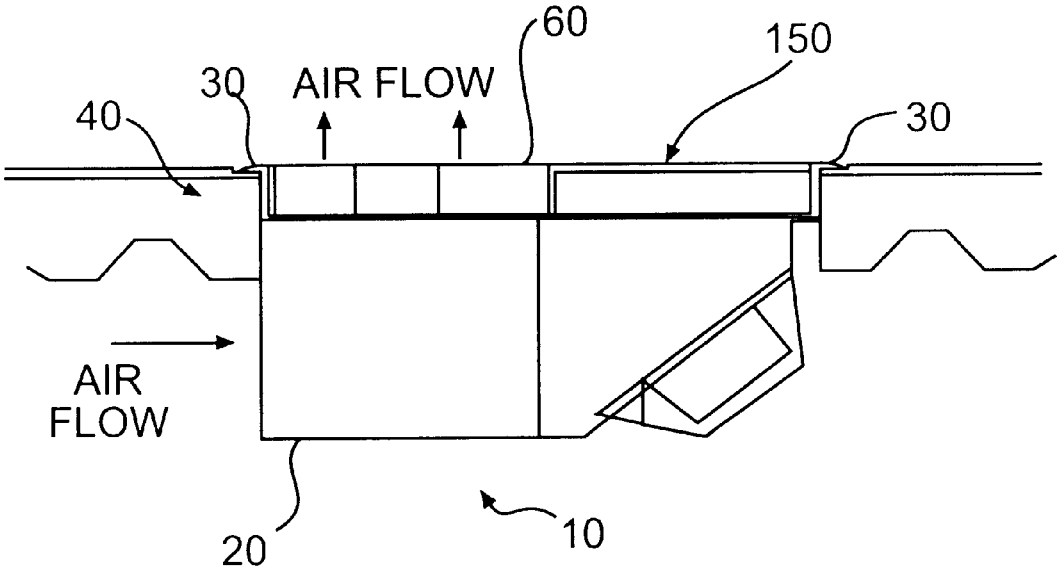
FIG. 13 is a cross-section of an eighth embodiment of the modular integrated terminal of the present invention.

The terminals of the invention also include the MIT-H, which includes either an MIT-A or MIT-B combined with an FAM unit, as shown in FIG. 13. In such an embodiment, both air flow and electrical wiring are introduced into the module, and the terminal 10 includes accessible outlets 150 at the floor 40. For example, one half of the upper portion of the module might have a grille 60, while another half might include outlets 150 for electricity or telecommunications purposes.

Figure 13A:
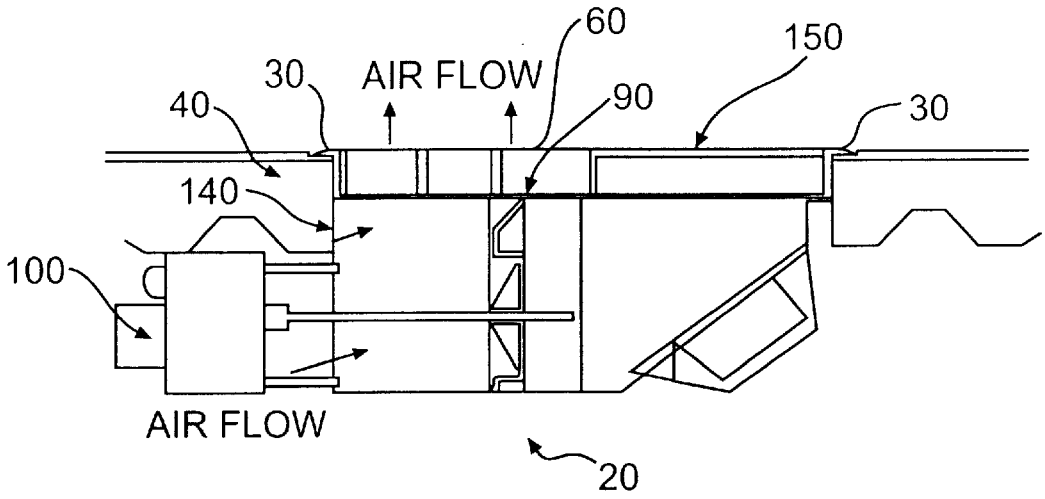
FIG. 13A is a cross-sectional view on line 13A—13A, showing a ninth embodiment of the modular integrated terminal of the present invention.
Figure 13B:
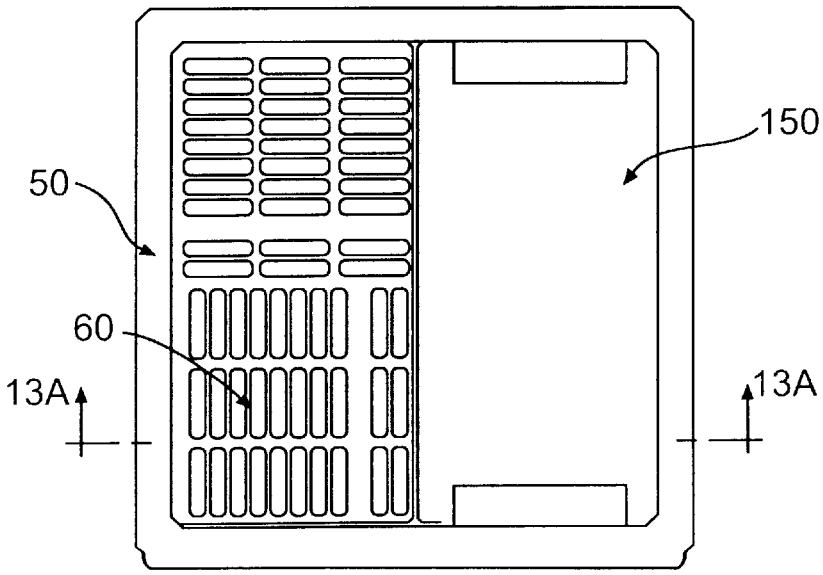
FIG. 13B is a plan view of a ninth embodiment of the modular integrated terminal of the present invention.

Another embodiment of the present invention combines the functions of an MIT-C with a FAM unit to deliver an MIT-I, shown in FIG. 13A. Here, though, the air is introduced on the motor 100 side of the housing 20, such as with the MIT-G.

Figure 14A:
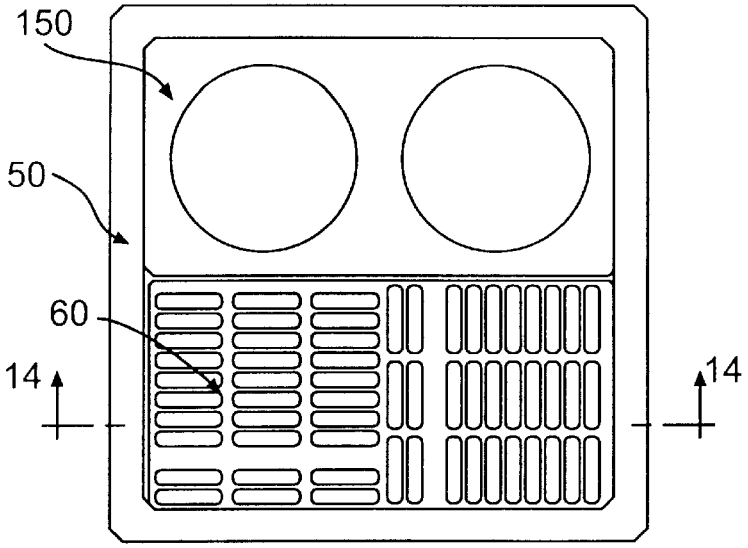
FIG. 14A is a plan view of a tenth embodiment of the modular integrated terminal of the present invention.
Figure 14:
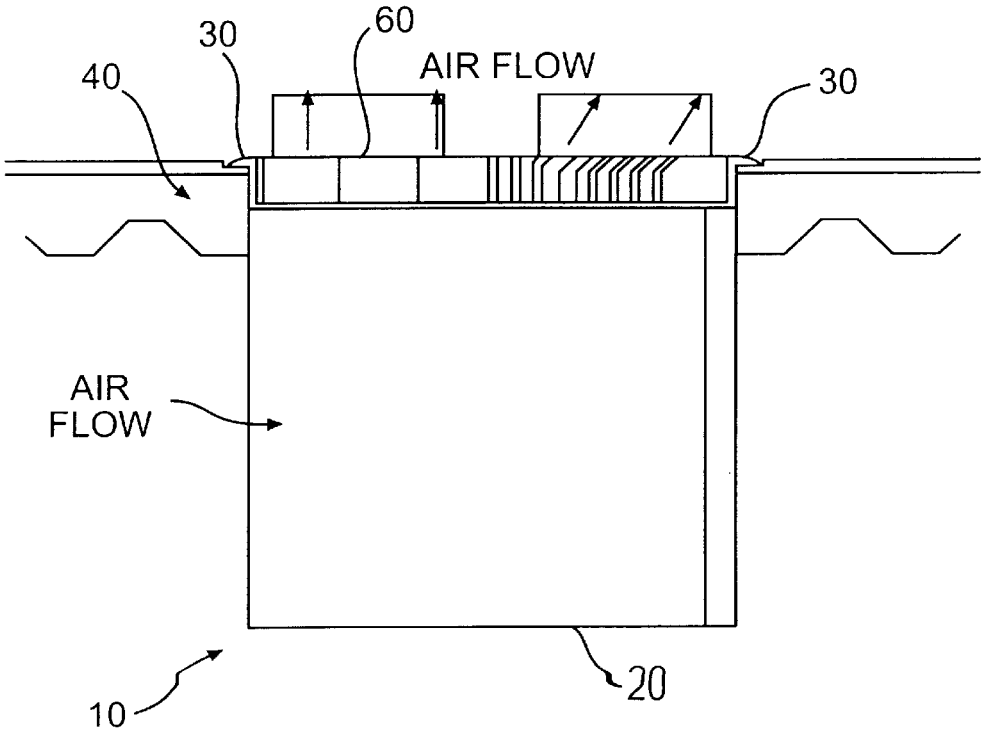
FIG. 14 is a cross-section of a tenth embodiment of the modular integrated terminal of the present invention.

FIG. 14 illustrates a PAM, which is a personal air delivery module. This module can be any of the MITs previously discussed for air flow delivery function. In this MIT, all or a portion of the grille 60 is replaced with a duct connection for flexible duct serving a desktop and/or furniture.

Apart from the MIT-A, MIT-B, and MIT-H, all of which require no controls, the MIT modules generally follow similar control sequences. With respect to the MIT-C, MIT-D, MIT-E, and MIT-I, and with reference to FIGS. 8, 9, 10, and 13A, the damper motor 100 drives the damper 90 from one side of the housing 20 to the other in response to the control system commands. In the unoccupied mode, the damper 90 is typically driven to a minimum position or closed. In the occupied mode, the damper 90 is driven to the open position in response to a control device, which is preferably a thermostat or controller/thermostat. The position of the damper 90 is incrementally changed, either further open or closed, to satisfy the thermostat command. The controller operation may include a minimum position for ventilation purposes. Global control functions may include a reporting of the damper 90 position for purposes of adjusting the supply pressure delivered by the conditioned air handling system. Local temperature, setpoint, and occupancy may also be reported. Response of the damper motor 100 may be altered in software to provide damping and stabilization of the control response. Another mode of operation is a life safety mode that supports engineered smoke control functions. In the event of a fire, the temperature control and occupied/unoccupied modes are overridden to either fully close or open the damper 90 in response to the system requirements. With respect to the MIT-I, the controller may additionally include an input point to monitor the position of the FAM cover 150 for security purposes, and an output point to control either power or telecommunications devices within the FAM portion of the unit.

The MIT-F, referring again to FIG. 11, includes two dampers. The grille damper 90 within the housing 21 provides volumetric control, and is controlled in the same manner as discussed above. The pressure control damper 95 within the duct connection 80, however, modulates to maintain a relatively constant pressure at the inlet point to the grille damper 90, thereby providing pressure independent operation for the MIT-F. The pressure is regulated by the opening and closing of the pressure control damper 95 using the inlet pressure and space pressure as references. During air balancing operations, the inlet pressure to the grille damper 90 may be adjusted to deliver the quantity of air desired for the unit at maximum flow.

The MIT-G, referring back to FIG. 12, follows the same control sequence as the MIT-C, MIT-D, and MIT-E when not in heating switchover operation. For heating switchover operation, the damper 90 is typically driven to the plenum side of the housing 20, either fully or partially eliminating, to reduce to minimum ventilation settings the delivery of plenum air. The duct connection 80 is connected to a heated air source and/or another MIT-G, which acts as a return unit for a fan powered terminal or air handling system. In heating mode, the flow of air is governed by the air handling system connected to the duct with temperature and volume controlled by the air handling unit. The controls may include a switchover interlock in software to prevent the simultaneous operation of the heating and cooling. For some critical applications, it may be desirable to permit the unit to deliver both warmed air from the duct and conditioned air from the plenum at the same time to provide reheat while cooling is being accomplished. With this simultaneous heating/cooling operation, the position of the damper 90 controls the volume or mixing of warmed and cooled air as needed to meet space conditions.

The various models of the MIT of the present invention can be applied to a variety of HVAC systems, or more broadly to building designs, to provide a highly integrated and flexible system to meet the building user's needs. Without in any manner limiting the full scope and spirit of the invention, a few examples of systems incorporating the module terminals of the present invention will be described in more detail below. It is understood, however, that these examples are merely representative of the wide variety of applications and uses of the present invention.

Figure 15:
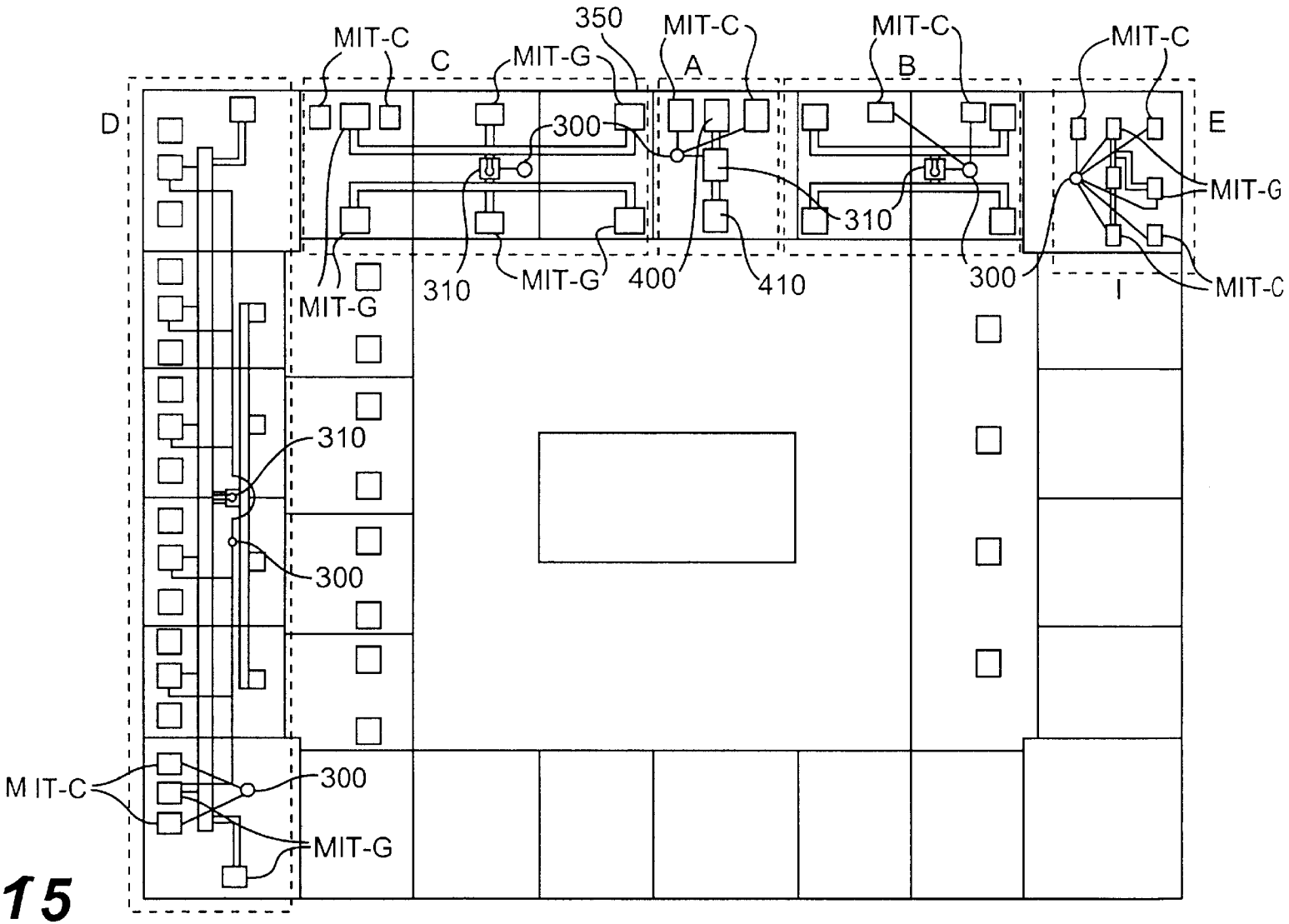
FIG. 15 is a partial plan view of a building floor illustrating an underfloor system applying principles of the present invention.

With reference to FIG. 15, there is shown a partial plan view of a floor of a building incorporating an integrated HVAC system that includes the modular terminals and principles of the present invention. The building includes one or more equipment rooms having heating, refrigeration, and/or air handling equipment to serve the building. An illustration of air handling equipment used to supply conditioned air to the floor plenums is described more fully in FIGS. 16, 18, and 19 for purposes of example only.

Generally, in the system disclosed in FIG. 15, pressurized conditioned air is supplied to the underfloor plenum. The air is supplied through either conventional air handling systems, or from systems specifically modified to include the preferred dehumidification and filtering aspects described more fully below. In addition, heated air can be introduced to the terminals, in this embodiment, through ducts located in the outer perimeter of the building. The heated air is supplied by conventional heating and air handling systems known to persons skilled in the art. In this particular system, the outer perimeter zones of the building have to be periodically heated or cooled to provide the desired temperature within the perimeter zones. In contrast, the interior spaces of the building typically only require constant or periodic cooling, which is achieved by the application of the conditioned air in the underfloor plenum system to modular terminals of the present invention, such as the MIT-A and MIT-C.

Referring back to FIG. 15, it is apparent that the interior MITs receive air from the air handling system through the plenums and apply that air directly to the interior spaces. For spaces where cooling is needed on a constant basis, terminals such as the MIT-A can be used. In spaces where the cooling needs to be adjusted relative to the load, sensors are placed in the system and those sensors control the motors, which in turn control the position of the dampers in variable air volume type MIT units, and thus the air flow.

In the system illustrated in FIG. 15, the perimeter zones need to be heated or cooled at different times of the year, or day. Moreover, the relative degree of cooling or heating needs to be controlled, relative to the load and the desired comfort of the person inhabiting the space. As will be described more fully below, the modular terminals of the present invention can be applied in systems which optimally provide cooling and heating in response to individual or zone sensors and controls. Many different systems and combinations are possible, depending upon the HVAC characteristics of the building. Some exemplary examples are described below.

In space A of FIG. 15, there is shown a system in which two terminals of the present invention are controlled by a sensor 300 responsive to the temperature loads and needs in a single office in the perimeter of a building. Illustrative components of that system are set forth in FIG. 17, for purposes of illustrating how specific MITs and principles of the invention can be applied to provide heating and cooling of perimeter zones.

Figure 17A:
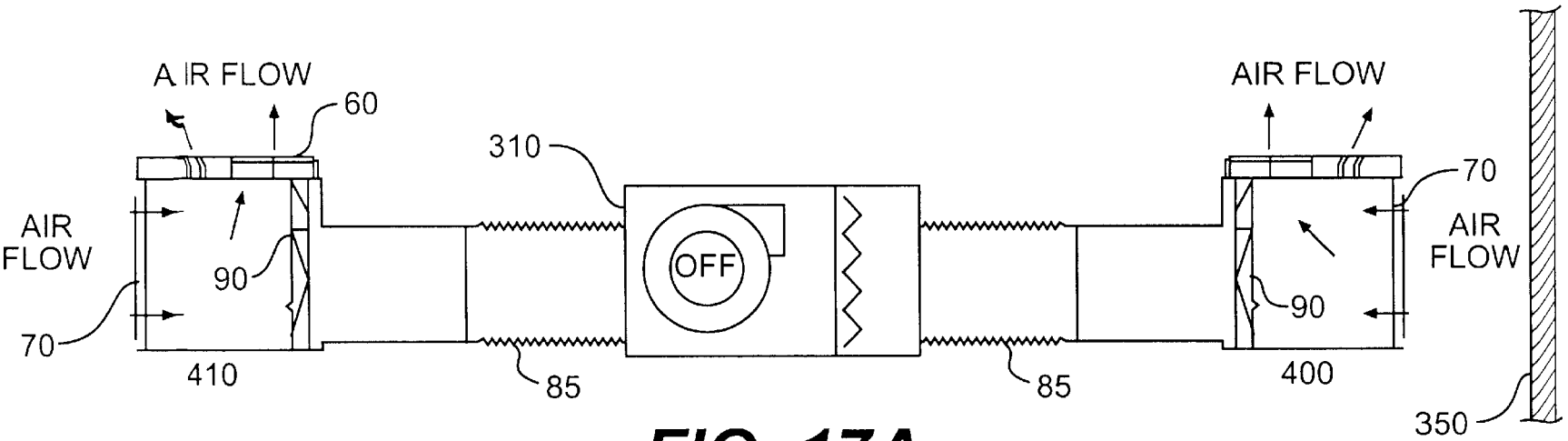
FIG. 17A is a schematic diagram illustrating the operation of components of the present invention during cooling mode in part of the system shown in FIG. 15.
Figure 17:
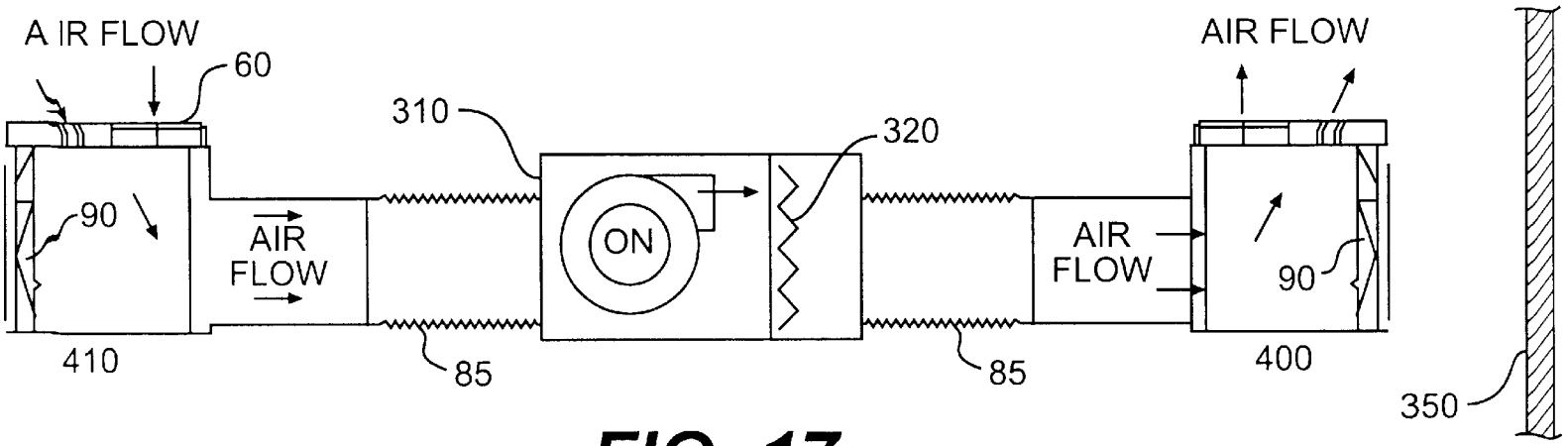
FIG. 17 is a schematic diagram illustrating the operation of components of the present invention during heating mode in part of the system shown in FIG. 15.

With reference to FIGS. 15, 17, and 17A, the MIT 400 adjacent the exterior wall 350 of the building is an MIT-G. The inward MIT 410 in this embodiment is also an MIT-G, but is pointed in the opposite direction. When the space is too cool and heat is required, the system is in the heating mode. In that mode, as is shown in FIG. 17, the damper 90 in the outward MIT-G 400 is slid all the way to the right or to the stop required for minimum ventilation from the underfloor supply, and the damper 90 in the inward MIT-G 410 is slid all the way to the left, by control signals applied to the respective motors. As a result, the openings of the terminals to the plenum are closed to their respective minimum positions and the only air that can be supplied to the space is minimum ventilation or heated air returned from one or more terminals supplied through ducts applied to one or more other MITs. The air required for heating is returned from the space by the inward MIT-G 410 and supplied by the fan/heater 310 through the outward MIT-G 400 back to the space. In the heating mode, therefore, the supply grille 60 is fully opened to the minimum ventilation stop. The damper on the inward MIT 410 is slid all the way to the left, thereby placing the grille 60 in the full open position and allowing it to function as a return from the conditioned space. This reduces the heating load of the equipment by not reheating cooled air in the plenum 230 for heating purposes.

Turning to FIG. 17A, when cooling of the space is required, the heating system and then subsequently the heating fan 310 are turned off, thereby cutting off the supply of hot air to and through the ducts 85. The slidable dampers 90 in the MITs 400, 410 can then be positioned through control signals to selectively open the inlets to the plenum and selectively vary the flow of cool air to the space, by changing the position of the dampers 90 in the MITs 400, 410. If additional cooling beyond the capacity of the MIT-G terminals is required, additional MIT-C cooling-only terminals can be added to the space, as illustrated in FIG. 15.

As will be apparent to persons skilled in the art, the system disclosed in FIGS. 15, 17, and 17A can be controlled through a thermostat 300 and actuator serving a given office or conference room space, or a larger zone. As shown in FIG. 15, several spaces can be controlled by a common thermostat 300, such system being shown as areas B and C. A corner office E similarly can have its own control. In area D, the heating is supplied for an entire wall of a given floor of a building and is independently controlled from a thermostat in a representative area to offset the cold transmitted through the wall or from any air leakage through the wall. In addition, individual room thermostats "trim" the temperature in response to individual room cooling loads.

Figure 16:
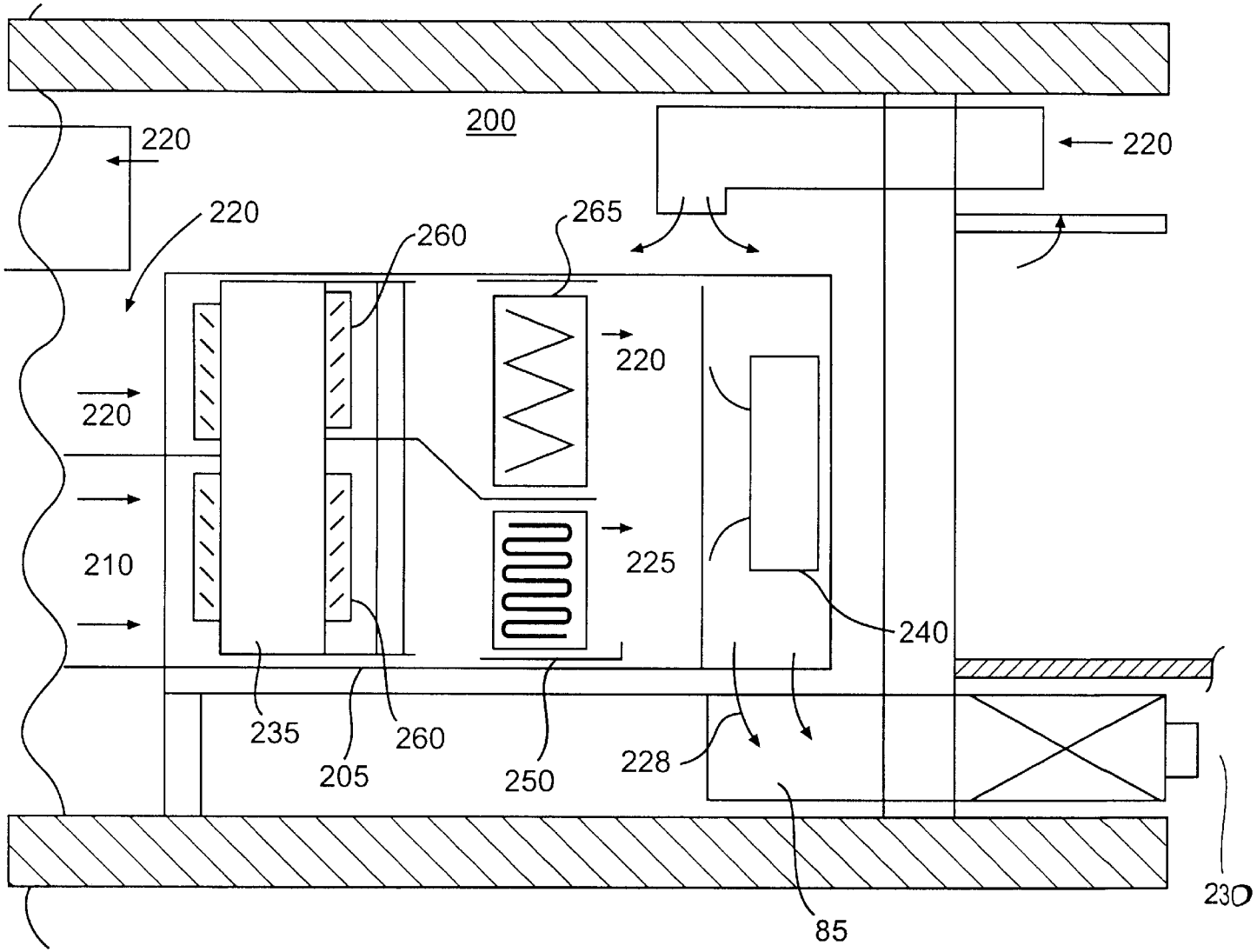
FIG. 16 is a schematic diagram of the air flow and air handling equipment of the system shown in FIG. 15.

In this system, the return air is returned from vents in the ceiling into the equipment room 200, shown schematically in FIG. 16. Based upon the air handling system and its controls, some of that return air 220 may be exhausted to the outdoors at a given time. Similarly, outside air 210 is introduced into the air handling unit 205 as desired, where it is mixed with return air 220 in the plenum 235, and then cooled and dehumidified through the coils 250. The conditioned air 225 is then mixed with bypassed return air 220, which has been cleaned by the high efficiency filter to achieve the desired supply air 228 temperature, as controlled by the top and bottom dampers 260. It is then introduced into the underfloor plenum 230 by a fan 240 either directly or through the distribution duct 85 to pressurize the space. Preferably the fan 240 is a plenum type that provides additional sound attenuation and lower discharge velocity into the raised floor system or its distribution duct.

As an example, return air 220 from the ceiling of the spaces being conditioned returns at a temperature within the range of 78° F. to 80° F., and the air supplied to the plenum 230 is approximately 60° F. to 65° F., so that it is not uncomfortably cold when applied into the space. These temperatures represent examples of temperatures that can be optimally applied to an underfloor system.

One aspect of the present invention is to control the flow and conditioning of the air in a manner which properly dehumidifies the air to beneficial limits, while also cleaning the air to achieve improved air quality. As shown in FIG. 16, this is achieved by placing controllable dampers 260 in front of the cooling coils 250 of the refrigeration system and the high efficiency filter 265 to provide two flow channels to the fan 240. One channel flows air to the cooling coil 250, and the other channel flows the remaining air through a high efficiency filter 265 to filter out contaminants in the return air. The lower damper 260 is preferably controlled so that the air cooled by the cooling coil 250 reaches a temperature (e.g., 50° F.), to get desired dehumidification and cooling of the air as it flows through the coil 250. This conditioned air 225, for example in the range of 50° F., is then mixed with the filtered return air at approximately 78° F. before and while it is supplied to and through the fan. The mixed air temperature is controlled by modulating the upper damper 260. The high efficiency filter 265 is selected such that the pressure drop through the filter 265 is essentially the same as the pressure drop through the conditioning coil 250. Therefore, the mixed filtered air and cooled air are at substantially the same pressure and ultimately leave the fan 240 at substantially the same temperature, preferably in the range of 60° F. to 65° F. This aspect of the present invention thus provides air which is well dehumidified and clean, at substantially no increased operating cost. Moreover, while only part of the return air 220 is filtered, the underfloor system utilizes a greater flow of air for cooling (because of the higher temperature) and thereby provides very good filtering and excellent ventilation.

In an application of this air handling system, a percentage of the air, for example, 30% to 50%, is bypassed around the cooling coil 250, to thereby provide better dehumidification of the air. This permits the air passing through the coil to be cooled below the saturation temperature and thereby dehumidify the air as it passes through the coil.

Figure 19:
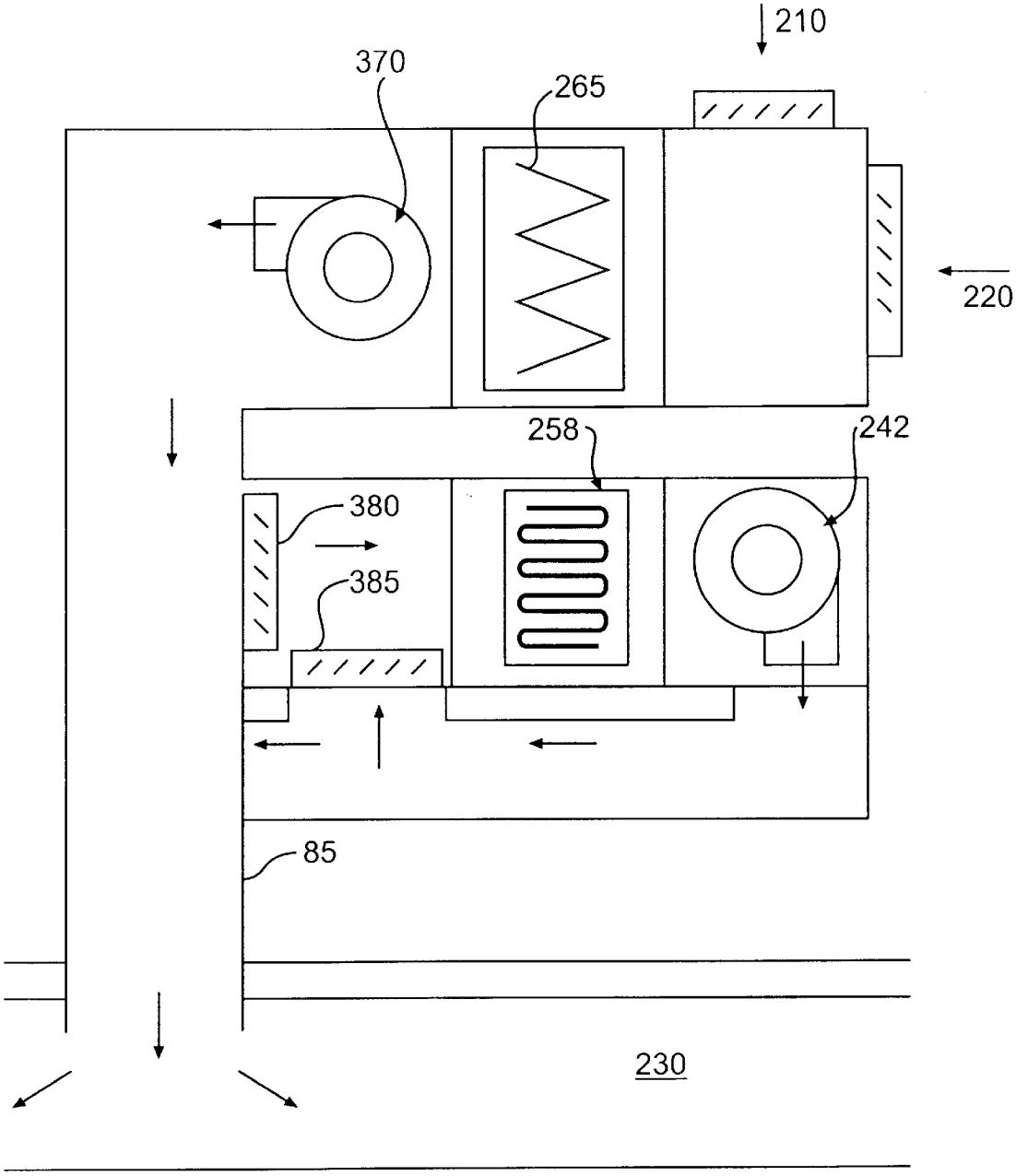
FIG. 19 is a block diagram of a second embodiment of an air handling unit for application with the underfloor system of the present invention.

Another air handling unit designed for application with an underfloor system of the present invention is the system illustrated in the block diagram in FIG. 19. In that system, a cooling fan 242 circulates air through a cooling coil 258 at a constant volume through a primary air side loop, and the other plenum pressurization fan 370 acts to maintain the desired flow pressure in response to varying air conditioning loads in the building. The cooling fan 242 preferably operates at a relatively low pressure and serves to maintain coil circulation as a function of load. In DX systems, the primary loop/cooling fan 242 would preferably be constant volume to prevent coil freeze-up, a problem common with variable air volume. In large systems, there would preferably be multiple cooling coils and fans in parallel that could be individually turned on or off in response to building loads. This design permits the plenum fan 370 to maintain the plenum pressure at a fixed or adjustable set point. The air temperature applied to the plenum 230 is controlled by dampers 380, 385 that adjust the amount of air exchanged between the coil loop and the plenum loop. Through these dampers 380, 385 and the related components, the mixed air temperature applied to the plenum 230 can be precisely set to maintain the desired plenum temperature, which can be reset by load or fixed, as desired.

The use of the two loops permits the coil 258 face to be reduced and also permits the air flowing through the coil 258 to be cooled to lower temperatures, thereby dehumidifying the air, as explained in the previous example. Preferably, the plenum fan 370 will vary the air volume and pressure to compensate for building load and the pressure increase from dirty filters.

The dampers 380, 385 are preferably factory interlocked to work together to maintain proper mixing. The plenum pressurized fan 370 is speed controlled according to the pressure sensed in the plenum 230.

The system of the present invention preferably includes either a chilled water air handling unit or a direct expansion air handling unit. Both units are preferably connected to a local return ceiling plenum and have full access to outside air through a duct connection.

Figure 18:
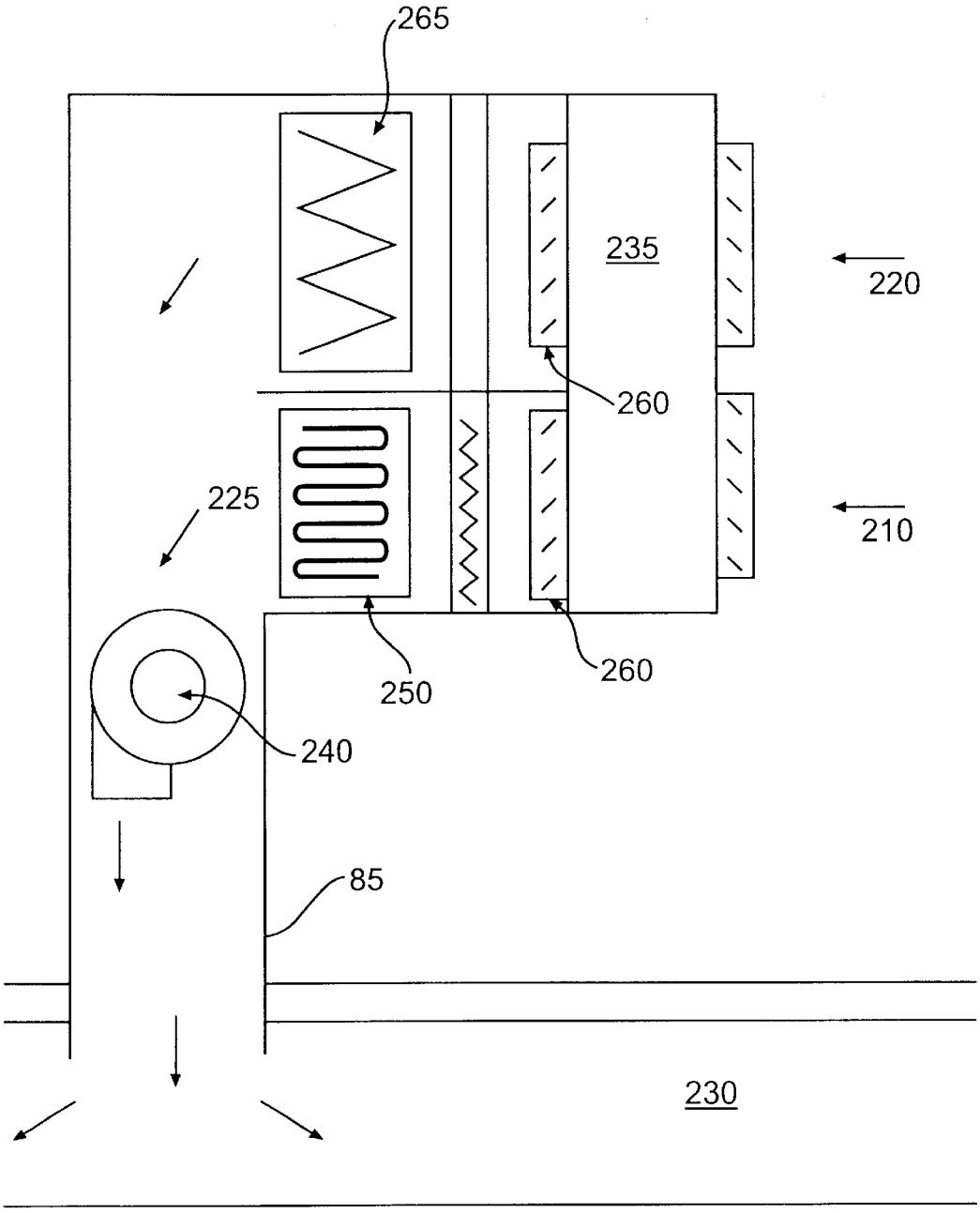
FIG. 18 is a block diagram of a first embodiment of an air handling unit for application with the underfloor system of the present invention.

The chilled water air handling unit, shown in FIG. 18, and the direct expansion air handling unit, shown in FIG. 19, each have a return air and an outside air connection. In both units, the outside air damper is normally closed and the return damper is normally open. When the unit is started in the occupied mode, the outside air damper opens to the minimum position. To adjust the quantity of outside air, the return damper is throttled to increase the negative pressure in the mixed air plenum and thereby draw in more outside air. The control system shall monitor the plenum pressure and adjust the damper position to obtain a plenum pressure that corresponds to the desired quantity of outside air. Because the plenum and dampers are generally constructed as a unit in the factory, the setpoints and calibration of the controls can be made prior to delivery to the field. For field installed controls, the setpoints would be obtained by air balance readings. In the case of the chilled water air handling unit, the unit is purposely packaged with the outside air damper more directly aligned with the chilled water coil section to create stratification of the outside stream from the return air stream. This feature assists in dehumidification of the outside air by directing the outside air to the cooling coil.

In both the chilled water and direct expansion air handling units, the desired amount of outside air may be determined by measurement of carbon dioxide on a demand basis, by calculation of occupancy, by design setpoint, or from operator input. The control sequence shall convert the CFM requirement into a required mixed air plenum pressure and damper position. If the pressure losses in the outside air duct is large, a fan may be installed to deliver outside air to the unit. The make-up air fan speed would be modulated in response to the mixed air plenum pressure to maintain the setpoint rather than modulate the return air damper, or the air flow through the make-up fan could be measured with an air flow measuring device and the fan speed or outside air damper position could be controlled to maintain the desired air flow.

In both units, the basic ventilation cycle is modified by an economizer cycle operation. If calculations indicate from comparison of the outside air conditions to the return air conditions that use of outside air beyond ventilation requirements is beneficial to energy reduction, the outside air damper is opened further as the return damper is further throttled to a fully closed position if necessary. Typically, the return damper closes to lower the ratio of return air to outside air and lower the discharge temperature when the outside air is cooler than the return air. When the economizer is operating, the outside and return dampers modulate to maintain the desired mixed air temperature as established by a variable setpoint. This setpoint shall be the same, or slightly lower to account for fan heat, as the discharge air setpoint when the unit is used without chilled water.

The operation of discharge temperature control differs among the units. In the chilled water air handling unit, the temperature control dampers installed on the coil 250 and bypass are both typically open. To maintain the desired discharge temperature setpoint when the unit is using chilled water for a cooling source, the bypass damper shall be modulated closed to lower the temperature and modulated open to raise the temperature. If the bypass damper is fully open and the discharge temperature is below the setpoint, then the chilled water coil face damper shall modulate closed to raise the discharge air setpoint. If the chilled water coil face damper is partially in the open position, it first modulates open if the discharge temperature is above the setpoint, and then the bypass damper modulates closed, in sequence. Alternatively, a less energy efficient option would allow one damper to close as the other opens, the dampers operating in unison but opposite to each other.

For the direct expansion air handling unit, the temperature control dampers installed on the cooling inlet and system bypass are both normally open. To maintain the desired discharge temperature setpoint when the unit is using mechanical refrigeration for a cooling source, the system bypass damper shall be modulated closed to lower the temperature and modulated open to raise the temperature. If the bypass damper is fully open and the discharge temperature is below the setpoint, then the cooling inlet discharge damper shall modulate closed to raise the discharge air setpoint. If the cooling inlet discharge damper is partially in the open position, it is first modulated open if the discharge temperature is above the setpoint, and then the bypass damper shall modulate closed, in sequence. The coil fan 242 shall operate whenever mechanical cooling is required and shutdown in economizer mode.

This design provides a primary/secondary airside loop with the DX coil 258 in a constant volume primary loop and the ventilation/pressurization fan in a variable air volume secondary loop. Mechanical cooling requirements shall be controlled by demand starting/stopping the compressor, or compressors, and a coil fan 242.

Both units utilize the same control method for fan speed. In the unoccupied and occupied modes, the units maintain a static pressure setpoint by raising or lowering the fan speed in response to a sensor that measures the plenum or duct static pressure. The setpoint may be an operator input value or a dynamic value determined from MIT demands. It shall also be adjusted to maintain desired air flow for occupied and unoccupied conditions. In the event of a life safety or smoke purge command, the fan speed may be overridden to the full speed output for smoke purge or pressurization.

With respect to the chilled water air handling unit, the chilled water valve is modulated closed whenever the coil discharge air temperature is below the setpoint and modulated open when it is above the setpoint. The setpoint is determined from the return air temperature and relative humidity. On high humidity or high load, as determined by high return temperatures, the setpoint shall be lowered, and on low humidity or low load, as determined by low return temperatures, the setpoint shall be raised.

For both units, generally, the exhaust air is preferably controlled by a duct and damper that relieves air from the return plenum to the exterior. The damper shall be controlled to maintain a stable space pressure as established by the setpoint. If required, an exhaust fan may also be used, with the fan speed modulated to maintain the stable space pressure setpoint.

For both air handling units, in the event the temperature/humidity setpoints, filter pressure drop, or discharge pressure was not correctly maintained, the system would alarm.

The chilled water air handling unit has good humidity control, delivers a constant volume of ventilation air while varying supply air volume, and provides a low airside pressure drop by placing the high efficiency filter restriction in parallel with the coil. This sidestream filtration method takes maximum advantage of the bypass design used to maintain a relatively high dry bulb discharge temperature with a colder coil discharge temperature.

The direct expansion air handling unit delivers the same advantages as the chilled water air handling unit. In addition, two fans are used so the unit can operate in a variable air volume delivery mode while maintaining constant air flow across the DX coil. When not required, the coil fan can be turned off with the refrigeration to save energy. When in the economizer mode, further energy is saved by shutting down the DX coil fan. Unlike conventional units, this unit does not pass air through the coil when in the economizer mode. From a service and operational view, the constant air flow through the DX coil helps prevent coil freezing by lowering the humidity and maintaining the air velocity regardless of load on the system. This allows the unit to operate at lower load points and total air flow.

Because of the unique construction features and operational properties of the above embodiments of the terminals, the modular integrated terminals of the present invention can be incorporated into air distribution systems and HVAC systems that have unique properties. This is feasible because of the MIT capability of air distribution. For example, the MIT can be used to produce a perimeter heating/cooling system that can both heat and cool a zone with automatic switchover. It can also provide simultaneous heating in some spaces and cooling in others. The MIT air terminal can be used for air return and supply functions, and can switch over using the integral damper assembly. It can switch from plenum supply to duct supply, or use both. To applicant's knowledge, no known floor terminal systems have these capabilities.

The invention permits the use of a modular terminal design that can be readily modified to meet a wide variety of HVAC needs and characteristics, while still keeping the same shape and size. This provides significant benefits in the design and manufacture phase of the terminal, as well as in the incorporation of the terminals of the present invention into a building. Moreover, the modular design permits the user to readily modify the HVAC system even after it is installed, since different modular terminals can be substituted for an installed terminal. The system is thus flexible and easy to modify, change, or add to at any given time.

In the preferred embodiment, the modular integrated terminal of the present invention is designed to match the appearance of non-air distribution devices like electrical distribution boxes that preferably share components with the modular integrated terminals to match appearance. Preferably, the modular terminal devices are designed to have a symmetrical shape, most preferably square, which permits the terminals to be rotated to a plurality of positions in standard sized holes in the floor. This allows the air inlets and other mechanisms in a given model of the terminal to be positioned in a manner that provides the optimum air flow characteristics for the particular system and space where the terminal is to be applied. The terminals of the present invention can also be designed to include non-air distribution functions such as the distribution of electrical power and/or telecommunication services.

The present invention introduces the integration of specific interchangeable components within a common housing to produce terminals that have a broad range of applications. The interchangeable modular components allow the terminals of the present invention to be incorporated in plenum air distribution systems (pressurized or non-pressurized), ducted air distribution systems, or a simultaneous ducted and plenum distribution system. The terminals can be used to supply a single source of heated or cooled air. The modular system, particularly when used for all HVAC, electrical, and telecommunications needs, provides the owner of a building with the ability to cost effectively adapt the interior environment to changing requirements over the life of the building structure. This allows a building to evolve in a real time mode, day-to-day, to accommodate user needs.

The MIT-based HVAC system can be modified by people of limited skill levels as compared with the high skill levels demanded by present systems. Such modifications can be performed quickly and easily without specialized tools and equipment.

The basic chassis can support one of several grille designs to provide the desired air flow characteristics. Grilles having different exit patterns on its opposite side can be turned in the chassis or flipped over to change the air pattern produced. The grilles can also be replaced to meet changing conditions. For example, one grille insert provides a connection point for a flexible duct that allows the terminal to act as an air valve for the distribution of air to furniture or desktop outlets. Because of the modularity of the present invention, major aspects of the system can be varied to meet space conditioning needs, even after the terminals are originally installed.

The present invention when applied to underfloor HVAC systems is cost effective in original installation and application. In addition, the system can be readily revised, should changes in the space usage or refinements in the HVAC application be desired. The system also provides improved HVAC comfort and efficiency.

The terminals and systems of the present invention can readily be incorporated into control systems that best meet the needs of the space and system into which they are incorporated. The terminals and any dampers or fans in the terminals can be fully integrated with controls to manage the flow of air in response to comfort, air quality, and life safety needs. Spaces to be heated can be zoned to personal preference with relative ease and expense. The terminals can provide comfort control by variable air volume delivery in response to a thermostat, air quality control by modulation of air flow in response to air quality need, and smoke control by modulation of air flow in response to sensed smoke. The terminals can operate in a stand alone, interconnected, or integrated mode with other building controls and systems.

The present invention also substantially eliminates the need for much ductwork. The interior spaces of the building are cooled by the combination of the open plenum in the floor and the modular integrated terminals that are open to the plenum and supply cooling air as desired. While some ductwork may be needed to heat the outside perimeter of the building, even the terminals in that area apply cool air through the floor plenum. As a result, the present invention is relatively inexpensive to build and install.

The present invention also provides better indoor air quality. Because the cooling air is introduced at a warmer temperature than a ceiling system, the system of the present invention applies a greater flow of air and therefore provides better ventilation. At the same time, the system pressure losses are typically less than conventional ceiling systems, thus resulting in opportunities for even lower operating costs than many overhead designs. The preferred embodiment of the invention also provides improved filtering of the air, at no increased operating cost. The air is also kept within acceptable humidity levels through the air handling aspects of the preferred embodiment. This decreases the risk of biological contamination.

The present invention also provides relatively low operating costs. The system requires few fans and has low energy consumption. The underfloor system of the present invention can be applied with no increased building height. In addition, it is believed that the overall first cost of the package is less than traditional ceiling designs. Moreover, it is believed that the system of the present invention is easier to engineer and has long term benefits for the building owner, such as less operation costs and lower costs associated with easier maintenance or revision.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A modular terminal for applying conditioned air to one or more spaces within a building having one or more surfaces including walls, floors, and ceilings, the modular terminal comprising:

a housing defining an interior space;

at least one inlet air passageway formed in said housing for receiving conditioned air from a source and into the housing;

at least one outlet air passageway formed in said housing for applying conditioned air from the housing to a space within the building; and at least one device associated with the housing for controlling the flow of air through the housing, wherein said housing is sized to fit within an opening in a surface of the building, said inlet air passageway is formed on a lateral side of said housing, and said housing is symmetrically shaped relative to the opening so that it can fit in a plurality of positions within said opening, whereby the flow of air through the housing can be controlled by varying the relative position of the housing within the opening.

2. The modular terminal of claim 1 further comprising an engagement flange formed on said housing for engaging a surface of the building and holding the housing in place relative to the building.

3. The modular terminal of claim 1 further comprising a flange adjacent said at least one air inlet passageway for connection to a duct supply.

4. The modular terminal of claim 1 wherein said controlling device includes at least one grille for covering at least a portion of said outlet air passageway, said grille including a plurality of air flow channels for directing the flow of air outwardly from said housing.

5. The modular terminal of claim 4 wherein said controlling device further includes at least one electrical outlet.

6. The modular terminal of claim 1 wherein said controlling device includes at least one duct connection for covering at least a portion of said outlet air passageway, said duct connection accepting a duct for directing the flow of air outwardly from said housing to furnishings within a building space.

7. The modular terminal of claim 4 wherein said flow channels formed in said grille direct the flow of air in a first direction when the grille is placed over the outlet air passageway in a first position and direct the flow of air in a second direction when the grille is placed over the outlet air passageway in a second position.

8. The modular terminal of claim 4 wherein said flow channels are perpendicular to the exterior surface of the grille on one side and are angled relative to the exterior surface of the grille on the other side.

9. The modular terminal of claim 4 wherein said flow channels direct the flow of air in at least in two different directions, when the grille is fit over the outlet air passageway of said housing.

10. The modular terminal of claim 4 wherein the flow of air through at least one of said flow channels is blocked.

11. The modular terminal of claim 4 wherein at least two grilles with their own respective air flow channels fit over said outlet air passageway.

12. The modular terminal of claim 1 wherein said controlling device includes a damper within the interior of said housing.

13. The modular terminal of claim 12 wherein said damper is aligned opposite the air inlet passageway and is moveable relative to the air inlet passageway to thereby control the flow of conditioned air to said housing through the air inlet passageway.

14. The modular terminal of claim 13 wherein a grille with a plurality of flow channels fits over the outlet air passageway, wherein said damper is moveable within said housing, and wherein said damper affects both the flow of air through the air inlet passageway as well as the flow of air through the outlet air passageway, as the damper is moved from one position to another.

15. A modular terminal for applying conditioned air to one or more spaces within a building having one or more surfaces including walls, floors, and ceilings, the modular terminal comprising:

a housing defining an interior space;

at least one inlet air passageway formed in said housing for receiving conditioned air from a source and into the housing;

at least one outlet air passageway formed in said housing for applying conditioned air from the housing to a space within the building;

a grille with a plurality of flow channels that fits over the outlet air passageway; and at least one device associated with the housing for controlling the flow of air through the housing, wherein said controlling device includes a damper within the interior of said housing, said damper being aligned opposite the air inlet passageway and being moveable relative to the air inlet passageway to thereby control the flow of conditioned air to said housing through the air inlet passageway, and further wherein said damper affects both the flow of air through the air inlet passageway as well as the flow of air through the outlet air passageway, as the damper is moved from one position to another, wherein further the damper includes a slidable plate sized to block the flow of air from the air inlet passageway when it is adjacent said air inlet passageway, said plate extending adjacent the flow channels of the grille and blocking the flow of air to the flow channels of the grille on the side of the plate opposite the air inlet passageway.

16. The modular terminal of claim 15 wherein said damper is sized to cover most, if not all, of the air inlet passage when it is placed immediately adjacent said air inlet passage.

17. The modular terminal of claim 16 further comprising a device for selectively altering the position of said damper.

18. The modular terminal of claim 17 wherein said device includes a motor and a mechanical connection between the motor and the damper.

19. The modular terminal of claim 18 wherein said mechanical connection is a threaded drive screw.

20. The modular terminal of claim 15 further comprising a flange adjacent said air inlet passageway for connection to a supply duct.

21. The modular terminal of claim 20 further comprising at least one second inlet air passageway for accepting air flow from a plenum within the building.

22. The modular terminal of claim 21 wherein said at least one second inlet air passageway is positioned radially from said other inlet air passageway.

23. The modular terminal of claim 21 further comprising a damper opposite at least one of said first and second air inlet passageways and an induction sleeve slidable within the flanges adjacent said air inlet passageway.

24. The modular terminal of claim 23 wherein the damper is a plate slidable within the interior space of the housing and the induction sleeve is fixed to the plate.

25. The modular terminal of claim 23 wherein said plate is sized to substantially block the flow of air through the inlet air passageway, when it is slid immediately adjacent said inlet air passageway.

26. The modular terminal of claim 25 wherein said induction sleeve is a cylindrical sleeve having a plurality of holes formed along its length.

27. The modular terminal of claim 26 wherein a plurality of positioning buttons for providing a clearance between the induction sleeve and the flange adjacent to the inlet air passageway are formed on at least one surface of the facing surfaces of the induction sleeve and the flange.

28. The modular terminal of claim 20 further comprising a pressure control damper formed within said flange positioned adjacent to said inlet air passageway.

29. The modular terminal of claim 28 wherein said pressure control damper is rotatably fixed to said flange.

30. A modular terminal for applying conditioned air to one or more spaces within a building having one or more surfaces including walls, floors, and ceilings, the modular terminal comprising:

a housing defining an interior space;

at least one inlet air passageway formed in said housing for receiving conditioned air from a source and into the housing;

at least one outlet air passageway formed in said housing for applying conditioned air from the housing to a space within the building; and at least one device associated with the housing for controlling the flow of air through the housing, wherein said device for controlling includes a damper in the form of a plate slidable within the interior space of the housing and wherein the housing includes two inlet air passageways, one formed on each side of the damper.

31. The modular terminal of claim 30 further comprising a flange adjacent one of the two inlet air passageways for connection to a duct.

32. The modular terminal of claim 31 wherein said plate is sized to substantially block the flow of air through each of said air inlet passageways, when it is slid immediately adjacent the respective inlet air passageways.

33. The modular terminal of claim 31 wherein at least one stop formed in the housing prevents the plate from reaching a position adjacent at least one inlet air passageway.

34. A system for applying conditioned air to one or more spaces within a building having one or more surfaces including walls, floors, and ceilings, the system comprising:

an underfloor plenum within the building to which conditioned air is to be applied;

an air handling system for applying conditioned air to the underfloor plenum; and at least one modular terminal in a floor of the building, said modular terminal including a housing defining an interior space, at least one inlet air passageway formed in said housing and in fluid communication with said underfloor plenum, at least one outlet air passageway formed in said housing for applying conditioned air from the housing to a space within the building, and at least one device associated with the housing for controlling the flow of air through the housing, said housing being symmetrically shaped relative to the opening so that it can fit in a plurality of positions within said opening, whereby the flow of air through the housing can be varied by altering the relative position of the housing within the opening.

35. The system of claim 34 wherein said at least one inlet air passageway is formed on at least one respective lateral side of said housing, and wherein said at least one device for controlling the flow of air includes a damper within the interior of the housing, said damper being aligned opposite one said inlet air passageway and being moveable relative to that inlet air passageway to thereby control the flow of conditioned air to the housing through that inlet air passageway, said damper further including a slidable plate sized to block the flow of air from said inlet air passageway when it is adjacent that inlet air passageway and to block the flow of air from that inlet air passageway to the outlet air passageway on the side of the plate opposite that inlet air passageway.

36. The system of claim 35 wherein a plurality of said modular terminals are placed in fluid communication with said underfloor plenum.

37. The system of claim 35 wherein said air handling system includes:

at least one fan for applying conditioned air to the underfloor plenum;

a return air inlet for accepting return air from the building;

an entry plenum for selectively mixing, when desired, and directing return air and outside air;

a cooling coil;

a filter;

a first flow channel from the entry plenum to said filter and a second flow channel from the entry plenum to the cooling coil; and a damper system for selectively directing part of the flow of air from the entry plenum through the cooling coil and remaining part of the air from the entry plenum through the filter; and a third flow channel downstream of the cooling coil and the filter for accepting air from the cooling coil and the filter, mixing the air, and applying the mixed air to the underfloor plenum.

38. The system of claim 37 further comprising a control system that selectively operates the damper system so that the air cooled by the cooling coil reaches a temperature sufficiently low to provide dehumidification of the air as it flows through the coil.

39. The system of claim 38 wherein the control system selectively operates the damper system so that the volume of air exiting the filter mixes with the air exiting the cooling coil to maintain a predetermined temperature range.

40. The system of claim 37 wherein the filter is a high efficiency filter selected such that the pressure drop through the filter is essentially the same as the pressure drop through the conditioning cold, whereby the mixed filtered air and cooled air applied to the third flow channel are substantially of the same pressure range.

41. The system of claim 37 wherein the damper system includes an outside damper aligned with the cooling coil.

42. The system of claim 37 wherein the damper system includes a return damper aligned with the filter.

43. The system of claim 38 wherein the control system operates the damper system to cause at least a portion of the air ultimately applied to the third channel to be applied to the filter.

44. The system of claim 36 wherein said air handling system includes a primary channel for mixing return air and conditioned air and applying the mixed air to the underfloor plenum;

at least one fan within the primary channel for applying pressurized air to the plenum;

a secondary cooling loop in fluid communication with the primary channel;

at least one cooling coil within the secondary cooling loop;

at least one fan within the secondary cooling loop for flowing air through the coil and applying it back to the primary channel; and a damper system for controlling the flow of air in and out of the secondary cooling loop, according to preselected criteria.

45. The system of claim 44 wherein the air temperature applied to the plenum is controlled by dampers that adjust the amount of air exchanged between the secondary cooling loop and the primary channel.

46. The system of claim 44 further comprising a high efficiency filter within the primary channel.

47. The system of claim 44 wherein the at least one fan within the primary channel varies the air volume and pressure to compensate for building loading.

48. The system of claim 44 further including dampers to selectively apply outside air to the primary channel.

49. The system of claim 36 wherein heating air is introduced to selected terminals through ducts and cooled air is applied to the selected terminals through the underfloor plenum.

50. The system of claim 49 including first and second modular terminals interconnected by a heating duct associated with a heating coil and fan, said terminals including inlets to the heating duct, the plenum, and the interior space, respectively.

51. The system of claim 50 including a damper system for closing off the inlets to the plenum when the terminals in communication with the heating duct are in a heating mode, thereby permitting one terminal to apply return air from the interior space to the heating coil and fan and the other terminal to apply heated air from the heating coil and fan to the interior space.

52. The system of claim 50 including a damper system for partially closing off the inlets to the plenum when the terminals in communication with the heating duct are in heating mode, thereby permitting one terminal to apply return air from the interior space to the heating coil and fan and the other terminal to apply heated air from the heating coil and fan and ventilating air from the plenum to the interior space.

53. The system of claim 50 wherein said damper system permits the flow of air from the plenum into the terminals at a selected rate, when the terminals are in a cooling mode.

54. The system of claim 53 wherein said damper system selectively varies the flow of cooled air to the space by changing the position of dampers within the terminals.

55. The system of claim 36 wherein individual spaces within the building include a temperature sensing device and whereby the flow control devices within the terminals are selectively opened and closed in response to the sensed space temperature.

56. A method for applying conditioned air to one or more spaces within a building having one or more surfaces including walls, floors, and ceilings, the method comprising:

forming an underfloor plenum within the building;

applying conditioned air to the underfloor plenum through an air handling system;

placing within the floor of the building a plurality of modular terminals, each modular terminal having at least one inlet air passageway in fluid communication with an air source and at least one outlet air passageway for applying conditioned air to a space within the building;

selectively altering the position of the terminal and its inlet air passageway relative to the flow of conditioned air, to thereby vary the flow of air into the terminal;

sensing a parameter within one or more spaces to be conditioned within the building; and controlling the flow of conditioned air through the modular terminals according to the sensed parameter.

57. The method of claim 56 wherein the air source for at least one modular terminal is said underfloor plenum.

58. The method of claim 56 wherein the air source for at least one modular terminal is a duct.

59. The method of claim 57 wherein the step of controlling is achieved at least in part through a device incorporated into one or more of the modular terminals.

60. The method of claim 59 wherein said device is a moveable damper.

61. The method of claim 60 wherein said movable damper is controlled to maintain a substantially constant flow of air regardless of fluctuations in said underfloor plenum.

62. The method of claim 60 including the step of applying conditioned air through an outlet air passageway of at least one terminal, at substantially the same velocity, at all load conditions where conditioned air is required.

63. The method of claim 58 further comprising the step of selectively applying heated air to at least some of the terminals, when heating of a space is required.

64. The method of claim 63 further comprising the step of selectively pulling return air through some of the terminals, heating that air, and then applying the heated air to other of said terminals, when heating of a space is required.

65. The method of claim 57 wherein an adjustable damper is directly associated with at least one said terminal and further comprising the step of selectively adjusting the position of said damper in response to the sensed parameter in the space served by the terminal.

66. The method of claim 65 wherein said damper affects both the flow of air through the inlet air passageway as well as the flow of air through the outlet air passageway, as it is adjusted from one position to another.

67. The method of claim 56 further comprising:

accepting return air from the ceiling;

circulating at least a portion of the return air, if required, through a cooling coil to a temperature sufficiently low to provide dehumidification of the return air as it flows through the coil;

supplying at least a portion of the remaining return air through a filter for cleaning the air; and applying a mixture of the cooled and filtered return air to the underfloor plenum.

68. The method of claim 57 further comprising bypassing a cooling coil, when cooling of a space with outside air is desired, to thereby avoid pressure losses associated with passing air through the cooling coil.

69. The method of claim 56 including the step of circulating return air from vents in the ceiling to an air handling system, conditioning the return air with the air handling system, and applying the conditioned air to the underfloor plenum.

70. A system for applying conditioned air to one or more spaces within a building having one or more surfaces including walls, floors, and ceilings, the system comprising:

an underfloor plenum within the building to which conditioned air is to be supplied;

an air handling system for supplying conditioned air to the underfloor plenum; and at least one modular terminal in a floor of the building, said modular terminal including a housing defining an interior space, at least one inlet air passageway formed in said housing and in fluid communication with said underfloor plenum, at least one outlet air passageway formed in said housing for supplying conditioned air from the housing to a space within the building, and at least one device associated with the housing for controlling the flow of air through the housing; wherein said air handling system includes:

at least one fan for supplying conditioned air to the underfloor plenum;

a return air inlet for accepting return air from the building;

an entry plenum for selectively mixing, when desired, and directing return air and outside air;

a cooling coil;

a filter;

a first flow channel from the entry plenum to said filter and a second flow channel from the entry plenum to the cooling coil;

a damper system for selectively directing part of the flow of air from the entry plenum through the cooling coil and remaining part of the air from the entry plenum through the filter; and a third flow channel downstream of the cooling coil and the filter for accepting air from the cooling coil and the filter, mixing the air, and supplying the mixed air to the underfloor plenum.

* * * * *